US007681673B2

(12) United States Patent
Kolachalam

(10) Patent No.: US 7,681,673 B2
(45) Date of Patent: Mar. 23, 2010

(54) DRILL BIT AND CUTTING ELEMENT HAVING MULTIPLE CUTTING EDGES

(75) Inventor: Sharath K. Kolachalam, Houston, TX (US)

(73) Assignee: Smith International, Inc., Houston, TX (US)

( * ) Notice: Subject to any disclaimer, the term of this patent is extended or adjusted under 35 U.S.C. 154(b) by 290 days.

(21) Appl. No.: 11/761,562

(22) Filed: Jun. 12, 2007

(65) Prior Publication Data

US 2008/0308320 A1 Dec. 18, 2008

(51) Int. Cl.
*E21B 10/46* (2006.01)

(52) U.S. Cl. ..... 175/430; 175/431

(58) Field of Classification Search ..... 175/428, 175/430, 431

See application file for complete search history.

(56) References Cited

U.S. PATENT DOCUMENTS

| | | | | |
|---|---|---|---|---|
| 3,442,342 | A | 5/1969 | McElya et al. | |
| 4,108,260 | A | 8/1978 | Bozarth | |
| 5,201,376 | A | 4/1993 | Williams | |
| 5,341,890 | A | 8/1994 | Cawthorne et al. | |
| 5,379,853 | A | 1/1995 | Lockwood et al. | |
| 5,746,280 | A | 5/1998 | Scott et al. | |
| 5,819,861 | A | 10/1998 | Scott et al. | |
| 5,868,213 | A | 2/1999 | Cisneros et al. | |
| 5,881,828 | A | 3/1999 | Fischer et al. | |
| 6,059,054 | A | 5/2000 | Portwood et al. | |
| 6,241,035 | B1 | 6/2001 | Portwood | |
| 6,290,008 | B1 | 9/2001 | Portwood et al. | |
| 6,510,910 | B2 * | 1/2003 | Eyre et al. | 175/430 |
| 6,550,556 | B2 * | 4/2003 | Middlemiss et al. | 175/430 |
| 6,604,588 | B2 * | 8/2003 | Eyre et al. | 175/374 |
| 7,086,488 | B2 | 8/2006 | Richman | |
| 7,316,279 | B2 * | 1/2008 | Wiseman et al. | 175/57 |
| 2003/0062201 | A1 | 4/2003 | Eyre et al. | |
| 2004/0084223 | A1 | 5/2004 | Richman | |
| 2005/0263327 | A1 | 12/2005 | Meiners et al. | |

* cited by examiner

*Primary Examiner*—William P Neuder

(57) ABSTRACT

A drill bit for cutting a borehole through an earthen formation comprises a bit body having a bit axis. In addition, the drill bit comprises a rolling cone cutter mounted on the bit body and adapted for rotation about a cone axis. Further, the drill bit comprises an insert having a base portion secured in the rolling cone cutter and having a cutting portion extending therefrom, the insert having an initial impact direction. The cutting portion of the insert has a cutting surface comprising a planar surface defining an extension height. Moreover, the cutting portion of the insert comprises an indentation extending at least partially through the upper planar surface, the indentation including a forward facing formation engaging surface and a lower surface defining a depth of the indentation.

46 Claims, 16 Drawing Sheets

DRILL BIT AND CUTTING ELEMENT HAVING MULTIPLE CUTTING EDGES

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND

1. Technical Field

The disclosure herein relates generally to earth boring bits used to drill a borehole for the ultimate recovery of oil, gas or minerals. More particularly, the disclosure relates to rolling cone rock bits and drag bits with an improved cutting structure and cutting elements.

2. Description of the Related Art

An earth-boring drill bit is typically mounted on the lower end of a drill string and is rotated by revolving the drill string at the surface or by actuation of downhole motors or turbines, or by both methods. With weight applied to the drill string, the rotating drill bit engages the earthen formation and proceeds to form a borehole along a predetermined path toward a target zone. The borehole formed in the drilling process will have a diameter generally equal to the diameter or "gage" of the drill bit. The length of time that a drill bit may be employed before it must be changed depends upon its ability to "hold gage" (meaning its ability to maintain a full gage borehole diameter), its rate of penetration ("ROP"), as well as its durability or ability to maintain an acceptable ROP.

One common earth-boring bit includes one or more rotatable cone cutters that perform their cutting function due to the rolling movement of the cone cutters acting against the formation material. The cone cutters roll and slide upon the bottom of the borehole as the bit is rotated, the cone cutters thereby engaging and disintegrating the formation material in its path. The rotatable cone cutters may be described as generally conical in shape and are therefore sometimes referred to as rolling cones, cone cutters, or the like. The borehole is formed as the gouging and scraping or crushing and chipping action of the rotary cones removes chips of formation material which are carried upward and out of the borehole by drilling fluid which is pumped downwardly through the drill pipe and out of the bit.

The earth disintegrating action of the rolling cone cutters is enhanced by providing the cone cutters with a plurality of cutting elements. Cutting elements are generally of two types: inserts formed of a very hard material, such as tungsten carbide, that are press fit into undersized apertures in the cone surface; or teeth that are milled, cast or otherwise integrally formed from the material of the rolling cone. Bits having tungsten carbide inserts are typically referred to as "TCI" bits or "insert" bits, while those having teeth formed from the cone material are commonly known as "steel tooth bits." In each instance, the cutting elements on the rotating cone cutters break up the formation to form new boreholes by a combination of gouging and scraping or chipping and crushing. The shape and positioning of the cutting elements (both steel teeth and tungsten carbide inserts) upon the cone cutters greatly impact bit durability and ROP and thus, are important to the success of a particular bit design.

In oil and gas drilling, the cost of drilling a borehole is proportional to the length of time it takes to drill to the desired depth and location. The time required to drill the well, in turn, is greatly affected by the number of times the drill bit must be changed in order to reach the targeted formation. This is the case because each time the bit is changed, the entire string of drill pipes, which may be miles long, must be retrieved from the borehole, section by section. Once the drill string has been retrieved and the new bit installed, the bit must be lowered to the bottom of the borehole on the drill string, which again must be constructed section by section. As is thus obvious, this process, known as a "trip" of the drill string, requires considerable time, effort and expense. Accordingly, it is always desirable to employ drill bits which will drill faster and longer, while maintaining a full diameter bore.

The length of time that a drill bit may be employed before it must be changed depends upon its rate of penetration ("ROP"), as well as its durability. Bit durability is, in part, measured by a bit's ability to "hold gage," meaning its ability to maintain a full gage borehole over the entire length of the borehole. Gage holding ability is particularly vital in directional drilling applications which have become increasingly important. If gage is not maintained at a relatively constant dimension, it becomes more difficult, and thus more costly, to insert drilling apparatus into the borehole than if the borehole had a uniform diameter. For example, when a new, unworn bit is inserted into an undergage borehole, the new bit will be required to ream the undergage hole as it progresses toward the bottom of the borehole. Thus, by the time it reaches the bottom, the bit may have experienced a substantial amount of wear that it would not have experienced had the prior bit been able to maintain full gage. This unnecessary wear will shorten the bit life of the newly-inserted bit, thus prematurely requiring the time consuming and expensive process of removing the drill string, replacing the worn bit, and another new bit downhole.

The geometry and positioning of the cutting elements upon the cone cutters greatly impact bit durability and ROP, and thus are critical to the success of a particular bit design. To assist in maintaining the gage of a borehole, conventional rolling cone bits typically employ a heel row of hard metal inserts on the heel surface of the rolling cone cutters. The heel surface is a generally frustoconical surface and is configured and positioned so as to generally align with and ream the sidewall of the borehole as the bit rotates. The inserts in the heel surface contact the borehole wall with a sliding motion and thus generally may be described as scraping or reaming the borehole sidewall. The heel inserts function to maintain a constant gage and to prevent the erosion and abrasion of the heel surface of the rolling cone. Excessive wear of the heel inserts leads to an undergage borehole, decreased ROP, increased loading on the other cutting elements on the bit, and may accelerate wear of the cutter bearing and ultimately lead to bit failure.

In addition to the heel row cutting elements, conventional bits typically include a gage row of cutting elements mounted adjacent to the heel surface but orientated and sized in such a manner so as to cut the corner of the borehole. In this orientation, the gage cutting elements generally are required to cut portions of both the borehole bottom and sidewall. The bottom surface of the gage row insert engages the borehole bottom while the radially outermost surface scrapes the sidewall of the borehole. Conventional bits also include a number of additional rows of cutting elements that are located on the cones in rows disposed radially inward from the gage row. These cutting elements are sized and configured for cutting the bottom of the borehole and are typically described as inner row or bottomhole cutting elements.

One conventional shape for heel row inserts used to scrape and ream the borehole sidewall is a cylindrical chamfered flat-topped cutting element. This shape provides substantial strength and durability; however, such heel row inserts have limited formation removal efficiency. In particular, such inserts only present a single cutting edge and a single cutting face or surface to the formation as it engages and reams the borehole sidewall. Consequently, such conventionally shaped heel row inserts tend to make only a single cut in the formation each time it engages the formation. While other, sharper and more aggressively shaped inserts commonly used in the gage row and/or inner row of a rolling cone cutter could potentially be employed to ream the borehole sidewall, however, such shapes are not as durable as the cylindrical flat-topped cutting element, particularly when employed in the highly abrasive scraping and reaming cutting modes encountered in the heel row. As a result, the use of such sharper and more aggressive conventional inserts in the heel row may lead to a compromised ability to hold gage, a lower ROP, and possibly require a premature trip of the drill string to change the bit.

Increasing bit ROP while maintaining good cutting element life to increase the total footage drilled of a bit is an important goal in order to decrease drilling time and recover valuable oil and gas more economically. Accordingly, there remains a need in the art for a drill bit and cutting structure that is durable and will lead to greater ROPs and an increase in footage drilled while maintaining a full gage borehole.

BRIEF SUMMARY OF SOME OF THE PREFERRED EMBODIMENTS

In accordance with at least one embodiment of the invention, a cutting element for a drill bit comprises a base portion having a base axis and an outer surface. In addition, the cutting element comprises a cutting portion extending from the base portion and having a cutting surface. A first reference plane parallel to and passing through the base axis divides the cutting surface into a leading section and a trailing section. Further, the cutting surface includes an upper substantially planar surface defining a first extension height and a beveled surface on the leading side disposed between the upper planar surface and the outer surface of the base portion. Still further, the cutting element comprises a first notch in the leading section of the cutting surface extending at least partially through the upper planar surface and the beveled surface, wherein the first notch includes a forward facing formation engaging surface.

In accordance with other embodiments of the invention, a cutting element for a drill bit comprises a base portion having a base axis and an outer surface. In addition, the cutting element comprises a cutting portion extending from the base portion and having a cutting surface. The cutting surface includes a planar upper surface defining an extension height and a radiused transition surface disposed between the upper planar surface and the outer surface of the base portion. Further, the cutting element comprises an indentation formed in the cutting surface and extending at least partially through the upper planar surface and the transition surface. The indentation includes a forward facing formation engaging surface and a lower surface defining a depth of the indentation measured perpendicularly from the upper planar surface.

In accordance with another embodiment of the invention, a drill bit for drilling for cutting a borehole through an earthen formation comprises a bit body having a bit axis. In addition, the drill bit comprises a rolling cone cutter mounted on the bit body and adapted for rotation about a cone axis. Further, the drill bit comprises an insert having a base portion secured in the rolling cone cutter and having a cutting portion extending therefrom, the insert having an initial impact direction. The cutting portion has a cutting surface comprises a planar surface defining an extension height. Moreover, the cutting portion comprises an indentation extending at least partially through the upper planar surface, the indentation including a forward facing formation engaging surface and a lower surface defining a depth of the indentation.

Thus, embodiments described herein comprise a combination of features and advantages intended to address various shortcomings associated with certain prior devices. The various characteristics described above, as well as other features, will be readily apparent to those skilled in the art upon reading the following detailed description of the preferred embodiments, and by referring to the accompanying drawings.

BRIEF DESCRIPTION OF THE DRAWINGS

For a more detailed description of the preferred embodiments, reference will now be made to the accompanying drawings, wherein.

DETAILED DESCRIPTION OF THE PREFERRED EMBODIMENTS

Figure 1:
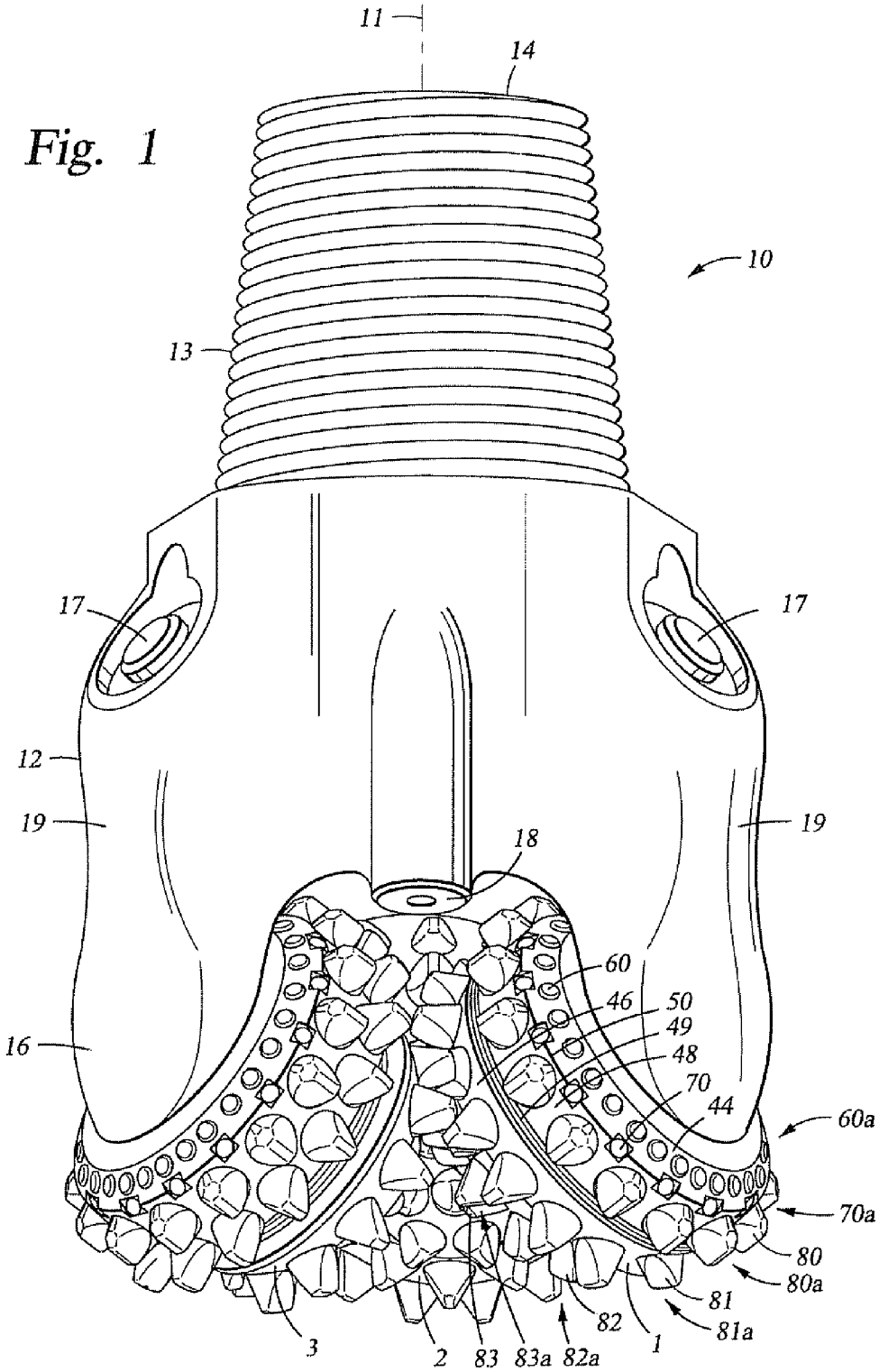
FIG. 1 is a perspective view of an earth-boring bit made in accordance with the principles described herein.

The following discussion is directed to various embodiments of the invention. Although one or more of these embodiments may be preferred, the embodiments disclosed have broad application, and the discussion of any embodiment is meant only to be exemplary of that embodiment, and not intended to intimate that the scope of the disclosure, including the claims, is limited to that embodiment or to the features of that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness. In the following discussion and in the claims, the terms "including" and "comprising" are used in an open-ended fashion, and thus should be interpreted to mean "including, but not limited to . . . ."

Referring first to FIG. 1, an earth-boring bit 10 is shown to include a central axis 11 and a bit body 12 having a threaded pin section 13 at its upper end that is adapted for securing the bit to a drill string (not shown). The uppermost end will be referred to herein as pin end 14. Bit 10 has a predetermined gage diameter as defined by the outermost reaches of three rolling cone cutters 1, 2, 3 which are rotatably mounted on bearing shafts that depend from the bit body 12. Bit body 12 is composed of three sections or legs 19 (two shown in FIG. 1) that are welded together to form bit body 12. Bit 10 further includes a plurality of nozzles 18 that are provided for directing drilling fluid toward the bottom of the borehole and around cone cutters 1-3. Bit 10 includes lubricant reservoirs 17 that supply lubricant to the bearings that support each of the cone cutters. Bit legs 19 include a shirttail portion 16 that serves to protect the cone bearings and cone seals from damage as might be caused by cuttings and debris entering between leg 19 and its respective cone cutter.

Figure 2:
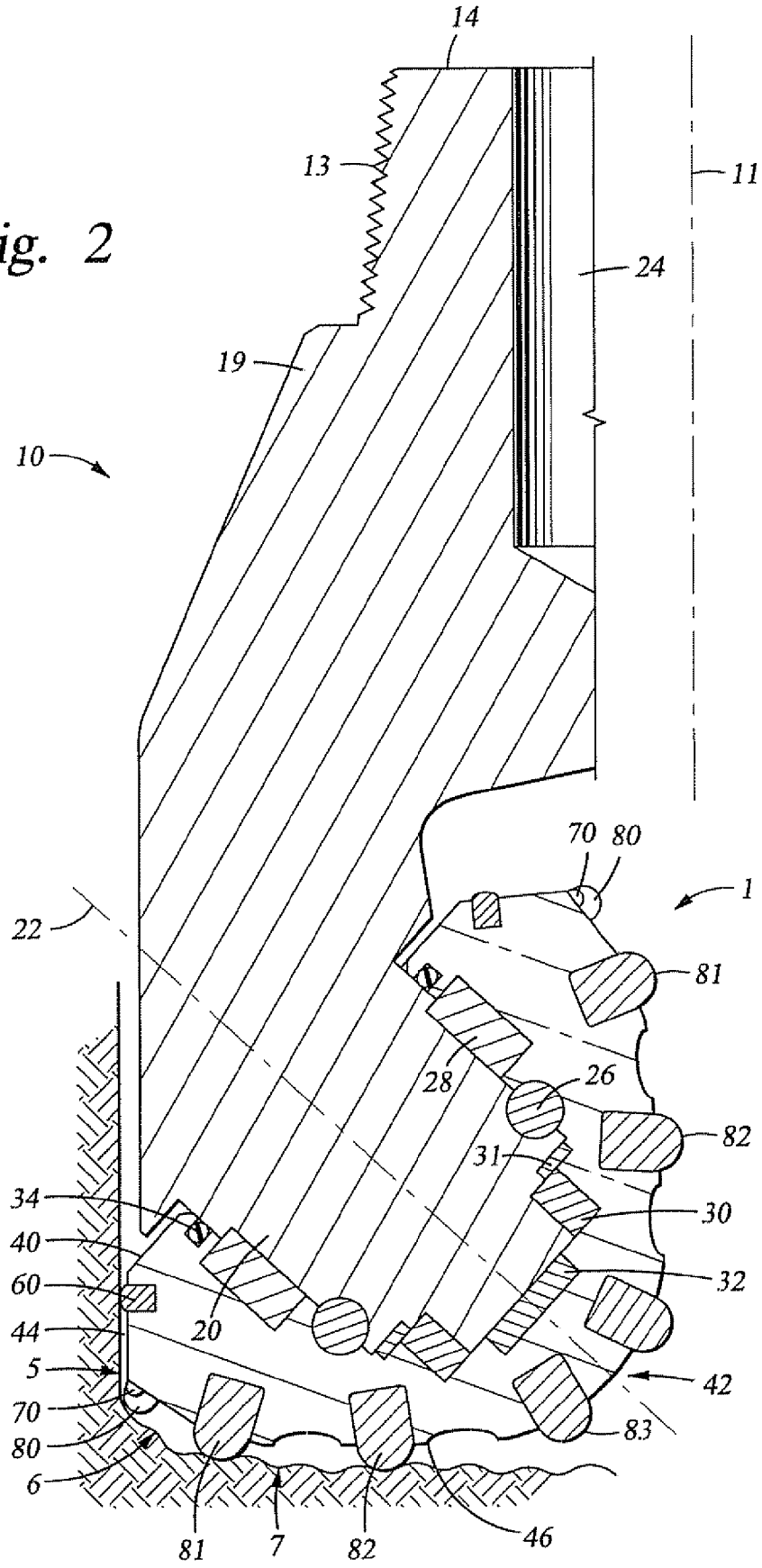
FIG. 2 is a partial section view taken through one leg and one rolling cone cutter of the bit shown in FIG. 1.

Referring now to both FIGS. 1 and 2, each cone cutter 1-3 is mounted on a pin or journal 20 extending from bit body 12, and is adapted to rotate about a cone axis of rotation 22 oriented generally downwardly and inwardly toward the center of the bit. Each cutter 1-3 is secured on pin 20 by locking balls 26, in a conventional manner. In the embodiment shown, radial and axial thrust are absorbed by roller bearings 28, 30, thrust washer 31 and thrust plug 32. The bearing structure shown is generally referred to as a roller bearing; however, the invention is not limited to use in bits having such structure, but may equally be applied in a bit where cone cutters 1-3 are mounted on pin 20 with a journal bearing or friction bearing disposed between the cone cutter and the journal pin 20. In both roller bearing and friction bearing bits, lubricant may be supplied from reservoir 17 to the bearings by apparatus and passageways that are omitted from the figures for clarity. The lubricant is sealed in the bearing structure, and drilling fluid excluded therefrom, by means of an annular seal 34 which may take many forms. Drilling fluid is pumped from the surface through fluid passage 24 where it is circulated through an internal passageway (not shown) to nozzles 18 (FIG. 1). The borehole created by bit 10 includes sidewall 5, corner portion 6 and bottom 7, best shown in FIG. 2.

Referring still to FIGS. 1 and 2, each cone cutter 1-3 includes a generally planar backface 40 and nose portion 42. Adjacent to backface 40, cutters 1-3 further include a generally frustoconical surface 44 that is adapted to retain cutting elements that scrape or ream the sidewalls of the borehole as the cone cutters rotate about the borehole bottom. Frustoconical surface 44 will be referred to herein as the "heel" surface of cone cutters 1-3. It is to be understood, however, that the same surface may be sometimes referred to by others in the art as the "gage" surface of a rolling cone cutter.

Extending between heel surface 44 and nose 42 is a generally conical surface 46 adapted for supporting cutting elements that gouge or crush the borehole bottom 7 as the cone cutters rotate about the borehole. Frustoconical heel surface 44 and conical surface 46 converge in a circumferential edge or shoulder 50, best shown in FIG. 1. Although referred to herein as an "edge" or "shoulder," it should be understood that shoulder 50 may be contoured, such as by a radius, to various degrees such that shoulder 50 will define a contoured zone of convergence between frustoconical heel surface 44 and the conical surface 46. Conical surface 46 is divided into a plurality of generally frustoconical regions or bands 48 generally referred to as "lands" which are employed to support and secure the cutting elements as described in more detail below. Grooves 49 are formed in cone surface 46 between adjacent lands 48.

In the bit shown in FIGS. 1 and 2, each cone cutter 1-3 includes a plurality of wear resistant cutting elements in the form of inserts which are disposed about the cone and arranged in circumferential rows in the embodiment shown. More specifically, rolling cone cutter 1 includes a plurality of heel inserts 60 that are secured in a circumferential row 60*a* in the frustoconical heel surface 44. Cone cutter 1 further includes a first circumferential row 70*a* of gage inserts 70 secured to cone cutter 1 in locations along or near the circumferential shoulder 50. Additionally, the cone cutter includes a second circumferential row 80*a* of gage inserts 80. The cutting surfaces of inserts 70, 80 have differing geometries, but each extends to full gage diameter. Row 70*a* of the gage inserts is sometimes referred to as the binary row and inserts 70 sometimes referred to as binary row inserts. The cone cutter 1 further includes inner row inserts 81, 82, 83 secured to cone surface 46 and arranged in concentric, spaced-apart inner rows 81*a*, 82*a*, 83*a*, respectively. Heel inserts 60 generally function to scrape or ream the borehole sidewall 5 to maintain the borehole at full gage and prevent erosion and abrasion of the heel surface 44. Gage inserts 80 function primarily to cut the corner of the borehole. Binary row inserts 70 function primarily to scrape the borehole wall and limit the scraping action of gage inserts 80 thereby preventing gage inserts 80 from wearing as rapidly as might otherwise occur. Inner row cutting elements 81, 82, 83 of inner rows 81*a*, 82*a*, 83*a* are employed to gouge and remove formation material from the remainder of the borehole bottom 7. Insert rows 81*a*, 82*a*, 83*a* are arranged and spaced on rolling cone cutter 1 so as not to interfere with rows of inner row cutting elements on the other cone cutters 2, 3. Cone 1 is further provided with relatively small "ridge cutter" cutting elements 84 in nose region 42 which tend to prevent formation build-up between the cutting paths followed by adjacent rows of the more aggressive, primary inner row cutting elements from different cone cutters. Cone cutters 2 and 3 have heel, gage and inner row cutting elements and ridge cutters that are similarly, although not identically, arranged as compared to cone 1. The arrangement of cutting elements differs as between the three cones in order to maximize borehole bottom coverage, and also to provide clearance for the cutting elements on the adjacent cone cutters.

Inserts 60, 70, 80-83 each include a generally cylindrical base portion with a central axis, and a cutting portion that extends from the base portion and includes a cutting surface for cutting the formation material. The base portion is secured by interference fit into a mating socket drilled into the surface of the cone cutter, the cutting portion and associated cutting surface extending beyond the surface of the cone cutter and defining the extension height of the insert. As used herein, the phrase "extension height" may be used to refer to the distance measured perpendicularly from the cone surface to the outermost point of the cutting surface or cutting structure of a cutting element (relative to the cone axis).

Figure 3:
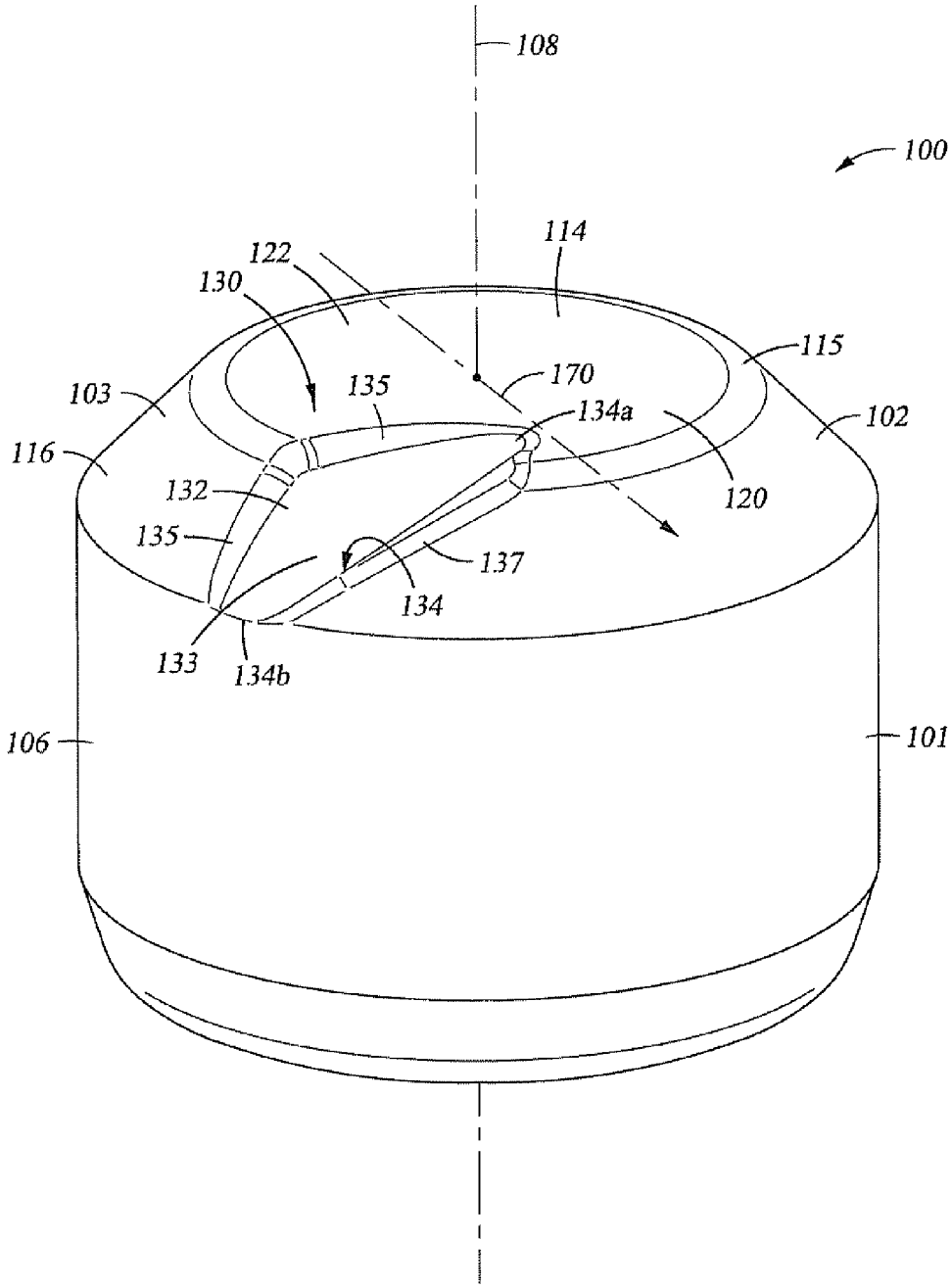
FIG. 3 is a perspective view of an embodiment of a cutting element useful in the drill bit shown in FIGS. 1 and 2.
Figure 4:
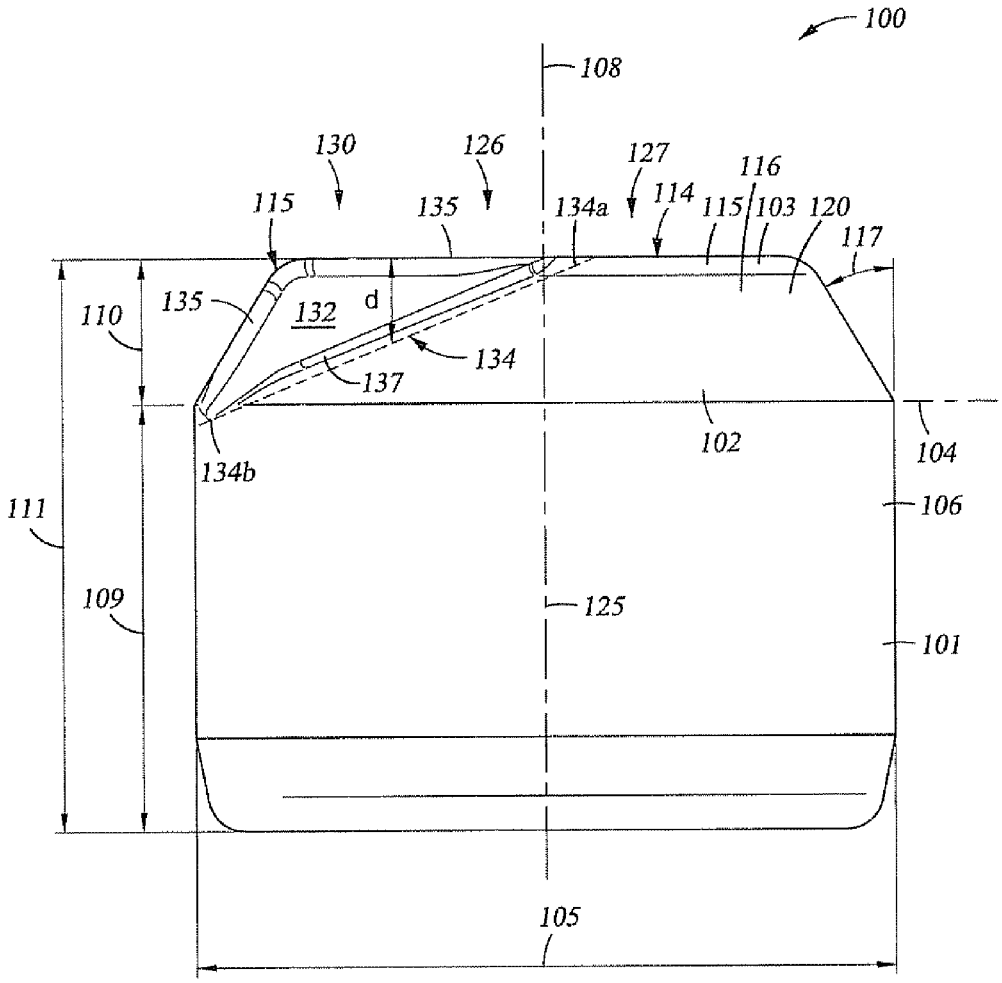
FIG. 4 is a front elevation view of the cutting element shown in FIG. 3.
Figure 5:
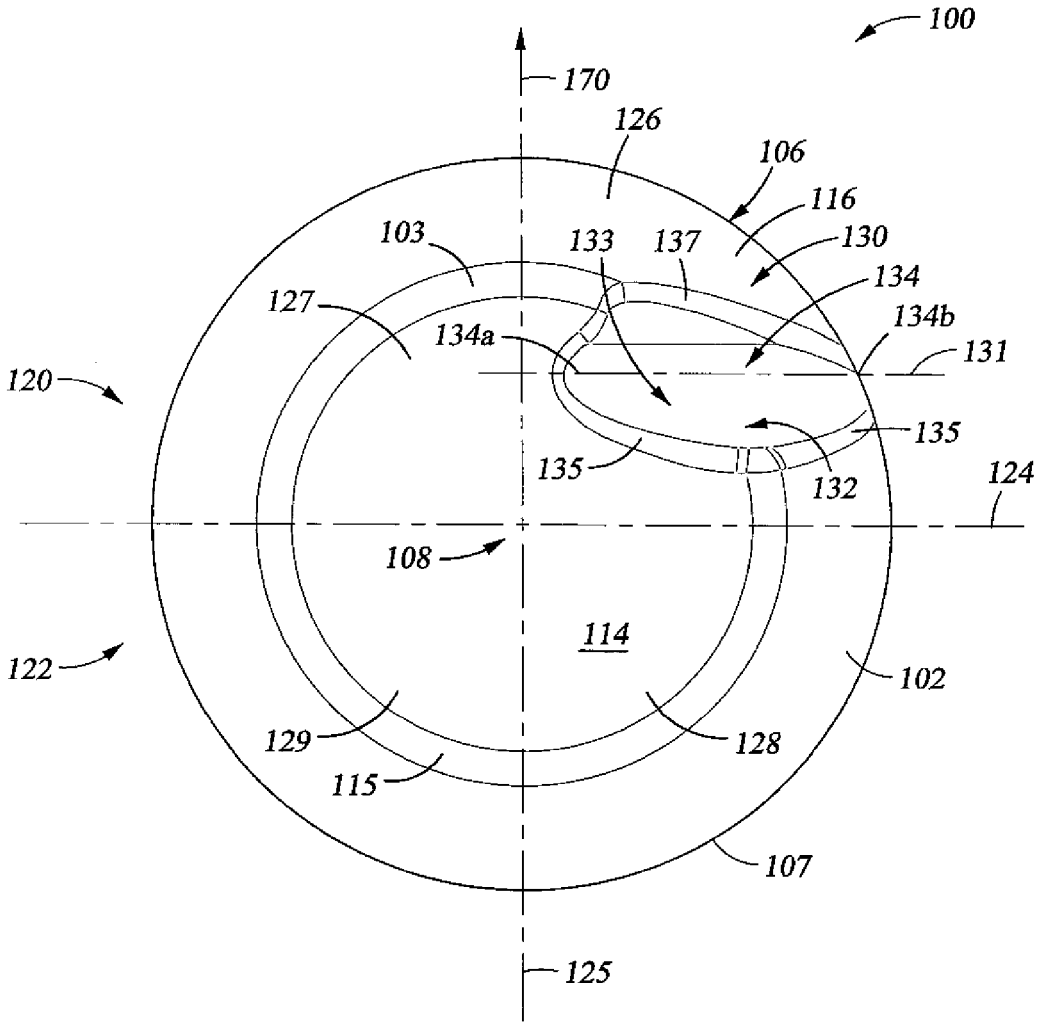
FIG. 5 is a top view of the cutting element shown in FIG. 3.

A cutting element 100 is shown in FIGS. 3-5 and is believed to have particular utility when employed as a heel row insert, such as in heel row 60*a* shown in FIGS. 1 and 2 above. However, cutting element 100 may also be employed in other rows and other regions on the cone cutter, such as in gage rows 70*a*, 70*b* and inner rows 81*a*, 82*a* shown in FIGS. 1 and 2.

Referring now to FIGS. 3-5, cutting element or insert 100 includes a base portion 101 and a cutting portion 102 extending therefrom. Cutting portion 102 includes a cutting surface 103 extending from a reference plane of intersection 104 that divides base portion 101 and cutting portion 102 (FIG. 4). In this embodiment, base portion 101 is generally cylindrical, having a diameter 105, a central axis 108, and an outer surface 106 defining an outer circular profile or footprint 107 of the insert (FIG. 5). As best shown in FIG. 4, base portion 101 has a height 109, and cutting portion 102 extends from base portion 101 so as to have an extension height 110. Collectively, base 101 and cutting portion 102 define the insert's overall height 111. Base portion 101 may be formed in a variety of shapes other than cylindrical. As conventional in the art, base portion 101 is preferably retained within a rolling cone cutter by interference fit, or by other means, such as brazing or welding, such that cutting portion 102 and cutting surface 103 extend beyond the cone steel. Once mounted, the extension height 110 of the cutting element 100 is generally the distance from the cone surface to the outermost point or portion of cutting surface 103 as measured perpendicular to the cone surface and generally parallel to the insert's axis 108.

Cutting surface 103 includes a generally planar upper or top surface 114 (e.g., generally flat top) and a frustoconical beveled or chamfered surface 116 disposed between upper surface 114 and cylindrical outer surface 106 of base portion 101. In this embodiment, both planar top surface 114 and beveled surface 116 are centered relative to axis 108, upper surface 114 generally positioned inside the annular or ring-shaped beveled surface 116.

Flat upper surface 114 is substantially perpendicular to axis 108 and generally defines extension height 110 of insert 100. As best shown in FIG. 4, beveled surface 116 is disposed at a bevel or chamfer angle 117 relative to an extension of outer surface 106 of base portion 101. In other words, bevel angle 117 is measured between beveled surface 116 and an extension of outer surface 106 or any line parallel to outer surface 106. Bevel angle 117 is preferably between 15° and 75°, and more preferably between 30° and 65°. In this embodiment, bevel angle 117 is about 55°. In other embodiments, the bevel angle (e.g., bevel angle 117) is about 45°.

Referring still to FIGS. 3-6, in this embodiment, cutting surface 103 also includes a rounded or radiused transition surface 115 disposed between beveled surface 116 and upper surface 114. In this manner, beveled surface 116 is smoothly blended with upper surface 114. In particular, transition surface 115 preferably has a radius of curvature between 0.010 in. and 0.040 in., and more preferably between 0.020 in. and 0.030 in. In this embodiment, transition surface 115 has a radius of curvature of about 0.025 in.

As best shown in FIG. 5, a reference plane 124 extending longitudinally and passing through axis 108 generally divides cutting surface 103 into a leading side or section 120 and a trailing side or section 122. In addition, a second reference plane 125 substantially perpendicular to reference plane 124 and intersecting base axis 108 further divides cutting surface 103 into four cutting surface quadrants: leading quadrants 126, 127 and trailing quadrants 128, 129. As shown in FIG. 5, leading quadrant 126 is the right portion of leading side 120, leading quadrant 127 is the left portion of leading side 120, trailing quadrant 128 is the right portion of trailing side 122, and trailing quadrant 129 is the left portion of trailing side 122. In this context, the references to right and left are mere terms of convenience.

In certain embodiments, insert 100 is positioned in the cone cutter such that it initially impacts or engages the formation in the general direction represented by arrow 170. Other orientations may also be employed as desired. It should be appreciated that the actual movement of a cutting element mounted to a rolling cone is relatively complex as the cone rotates about the cone axis, the bit body rotates about the longitudinal axis of the drill string, and the bit advances linearly downward to form the borehole. It is known in the art that the movement of a cutting element mounted to a rolling cone is not purely linear, but rather, is often described as helical. Thus, it should be appreciated that impact direction 170 represents the direction of movement of insert 100 at the time that it initially strikes or impacts the formation.

Referring still to FIGS. 3-6, an indentation 130 is provided in cutting surface 103 on leading side 120. In this embodiment, indentation 130 is an elongate cutout or notch, and thus, may also be referred to herein as notch 130. Notch 130 extends longitudinally along an elongate, substantially straight or linear median line 131 in the top view (FIG. 5). Median line 131 is generally parallel to first reference plane 124 but slightly offset from first reference plane 124 on leading side 120. Consequently, median line 131 is generally perpendicular to second reference plane 125. In addition, notch 130 pierces a portion of planar surface 114 and beveled surface 116. As best shown in FIG. 5, in this embodiment, notch 130 passes completely through beveled surface 116, and thus, may be described as interrupting or breaking the continuity of the annular beveled surface 116.

Notch 130 comprises a formation engaging surface 132 and a generally concave lower or bottom surface 134. Formation engaging surface 132 generally represents the portion of cuffing surface 103 within notch 130 that is visible when insert 100 is viewed along the impact direction 170 and perpendicular to axis 108 (FIG. 4). However, it should be appreciated that bottom surface 134 of notch 130 is generally not visible in front view and is represented by a hidden dashed line (FIG. 4). Bottom surface 134 is best seen in top view (FIG. 5). In this embodiment, a smoothly curved transition surface 133 is disposed between formation engaging surface 132 and recessed bottom surface 134 to smoothly blend surfaces 132, 134. Relative to impact direction 170, bottom surface 134 precedes transition surface 133, which precedes formation engaging surface 132 (i.e., formation engaging surface 132 trails surfaces 133, 134).

Elongate bottom surface 134 extends between an inner or first end 134*a* and an outer or second end 134*b*, and defines the depth "d" of notch 130 (FIG. 4) as measured perpendicularly from planar surface 114. As used herein, the terms "axial" and "axially" may be used to refer to surfaces or movements that are generally parallel to the base axis (e.g., base axis 108). The length of bottom surface 132 and notch 130 is generally the distance between first end 134*a* and second end 134*b*. In other embodiments, the locations of the ends (e.g., first end 134*a*, second end 134*b*) of the bottom surface (e.g., bottom surface 134) may differ, resulting in a longer or shorter notch. For instance, in other embodiments, the bottom surface (e.g., bottom surface 134) and the notch (e.g., notch 130) may extend across the reference plane dividing the insert into right and left halves (e.g., reference plane 125.)

Referring still to FIGS. 3-6, first end 134*a* is disposed at and coincident with planar surface 114, and second end 134*b* is disposed at and coincident with outer surface 106 of base portion 101 proximal the intersection of beveled surface 116 and outer surface 106 at reference plane 104. In addition, bottom surface 134 generally slopes down and away from planar surface 114 moving from first end 134*a* to second end 134*b*. Consequently, depth d of notch 130 varies along the length of notch 130 from first end 134*a* to second end 134*b*. In particular, depth d of notch 130 generally increases moving from first end 134*a* towards second end 134*b*, and more specifically, depth d increases linearly between first end 134*a* and second end 134*b*. Thus, the depth d of notch 130 at first end 134*a* is least at first end 134*a* and greatest at second end 134*b*. It should be appreciated that the depth d at first end 143*a* is zero since first end 134*a* is coincident with planar surface 114 in this embodiment. Also in this embodiment, the depth d of notch 130 at second end 134*b* (i.e., at the outer periphery of insert 100 represented by cylindrical outer surface 106 of base portion 101), is about equal to extension height 110. Thus, notch 130 may be described as extending at least partially to reference plane 104. In other embodiments, the depth (e.g., depth d) of the notch (e.g., notch 130) at various points along its length may vary from that described with reference to insert 100. For instance, the depth of the notch at the outer periphery of the insert (e.g., insert 100) may be less than or greater than the extension height (e.g., extension height 110) of the insert.

Formation engaging surface 132 is slightly curved, but substantially forward facing. As used herein, "forward facing" may be used to describe the orientation of a surface on a cutting element that is perpendicular to, or at an acute angle relative to, the direction of strike or impact of the cutting element with the formation (e.g., perpendicular to the direction of impact 170). In this embodiment, formation engaging surface 132 is substantially perpendicular to the impact direction of cutting element 100 represented by arrow 170. Although the formation engaging surface (e.g., formation engaging surface 132) is preferably forward facing, in other embodiments, the formation engaging surface of the notch (e.g., notch 130) may include a backrake angle or siderake angle as desired.

Referring still to FIGS. 3-5, notch 130 forms a leading cutting edge 137 with beveled surface 116 on one side of notch 130, and a trailing cutting edge 135 with planar surface 114 and beveled surface 116 on the other side of notch 130. More specifically, formation engaging surface 132 of notch 130 intersects with planar surface 114 and beveled surface 116 to form the continuous trailing cutting edge 135.

In the front view of FIG. 4, trailing cutting edge 135 extends along planar surface 114 at extension height 110 between first end 134*a* and transition surface 115 between planar surface 114 and beveled surface 116. From there, trailing cutting edge 135 slopes down and away generally along beveled surface 116 to second end 134*b*. Leading cutting edge 137 is continuous with transition surface 115 and generally slopes down and away from planar surface 114 as it extends from first end 134*a* to second end 134*b*. As a result of this configuration and orientation, leading cutting edge 137 is axially disposed below trailing cutting edge 135 in front view. Consequently, formation engaging surface 132 and associated cutting edge 135 are visible when viewed along the impact direction 170 perpendicular to axis 108, and further, are not shielded or blocked from the formation upon impact of insert 100 and the formation. Thus, as used herein, the phrase "formation engaging" as used to describe a surface on a cutting element or insert refers to a surface that impacts the formation and is visible when viewed along a line representing the impact direction of the cutting element.

Each cutting edge 135, 137 is preferably radiused, each having a radius of curvature between 0.010 in. and 0.040 in., and more preferably between 0.020 in. and 0.030 in. In this embodiment, each cutting edge 135, 136, 137 has a radius of curvature of about 0.025 in. In other embodiments, one or more cutting edges 135, 137 may not be radiused, but rather be relatively sharp.

Without being limited by this or any particular theory, by radiusing the cutting edges of an insert (e.g., cutting edges 135, 137 of insert 100), impact forces imposed by the formation on the cutting surface of the insert are spread out over a larger surface area, thereby reducing stress concentrations in the insert upon impact and engagement with the formation. Consequently, radiused cutting edges offer the potential to reduce the likelihood of premature chipping and cracking of the insert, and enhance the durability and lifetime of the insert.

Figure 6:
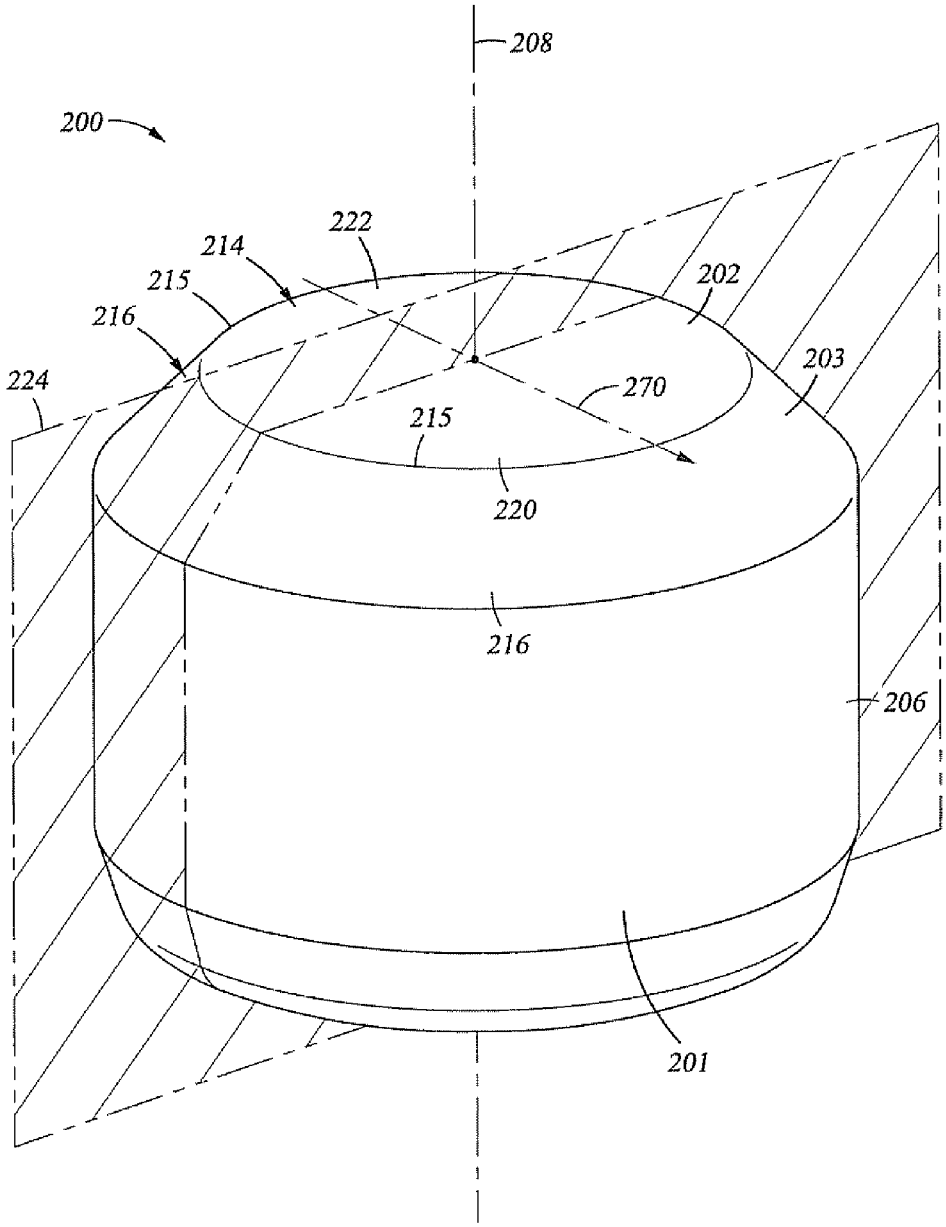
Fig. 6 (PRIOR ART)
FIG. 6 is a perspective view of a conventional prior art heel row cutting element.

Referring now to FIG. 6, a conventional prior art heel row insert cutting element 200 is shown. Conventional heel row insert 200 has a central axis 208 and includes a base portion 201 and a cutting portion 202 extending therefrom. Base portion 201 is cylindrical having an outer surface 206. Cutting portion 202 includes a cutting surface 203 comprising a flat upper surface 214 defining the extension height of insert 200 and a beveled surface 216 extending between upper surface 214 and outer cylindrical surface 206 of base portion 201. Upper surface 214 meets beveled surface 216 in a relatively sharp cutting edge 215. Conventional heel row insert 200 has an impact direction represented by arrow 270, and consequently may be divided by a plane 224 into a leading half 220 and a trailing half 222. It should be appreciated that plane 224 is parallel with and intersects axis 208.

Base portion 201 is conventionally retained in the rolling cone cutter such that only cutting portion 202 and cutting surface 203 extend beyond the cone steel and engage the formation. Without being limited by this or any particular theory, as conventional heel row insert 200 impacts and engages the formation in the general direction of arrow 270, beveled surface 216 on leading side 220 (shaded in FIG. 6) is the only formation engaging surface presented to the uncut formation. It should be appreciated that cylindrical surface 206 of base portion 201 is retained within the cones steel and is thus not exposed to the formation, and further, flat upper surface 216 is substantially parallel to the uncut formation and thus, tends to slide across the formation following the shearing action of beveled surface 216 and cutting edge 215 on leading side 220. Consequently, only beveled surface 216 on leading side 220 and cutting edge 215 on leading side 220 are available for shearing the formation. In other words, conventional heel row insert 200 presents one cutting surface and one cutting edge to the formation upon impact.

To the contrary, embodiments of insert 100 previously described include no less than two distinct cutting surfaces and two distinct cutting edges configured and positioned to shear and cut the formation upon impact. Without being limited by this or any particular theory, it is presently believed that as insert 100 impacts the formation in the direction represented by arrow 170, beveled surface 116 on leading side 120 and formation engaging surface 132 of notch 130 each present a distinct cutting surface to the formation upon impact. In addition, the continuous cutting edge formed by transition surface 115 and leading cutting edge 137 and trailing cutting edge 135 each generally provide a distinct cutting edge to the formation upon impact. Thus, embodiments of insert 100 are intended to provide no less than two distinct cutting surfaces and two distinct cutting edges to the uncut formation. Thus, embodiments of indentation or notch 130 provide at least one additional cutting surface and at least one addition cutting edge. Therefore, as used herein, the phrase "indentation" may be used to refer to a cutting surface feature or structure that provides an additional formation engaging cutting surface and an additional formation engaging cutting edge.

As compared to a similarly sized conventional heel row insert (e.g., insert 200), inclusion of forward facing formation engaging surface 132 offers the potential to increase the total surface area on insert 100 available for formation engagement and removal as compared to some similarly sized conventional heel row insert (e.g., conventional heel row insert 200 previously described). Without being limited by this or any particular theory, it is believed that by increasing the surface area available for cutting, as well as increasing the number of cutting edges available for formation removal, embodiments of insert 100 offer the potential for efficient formation removal and desirable ROP.

Figure 7:
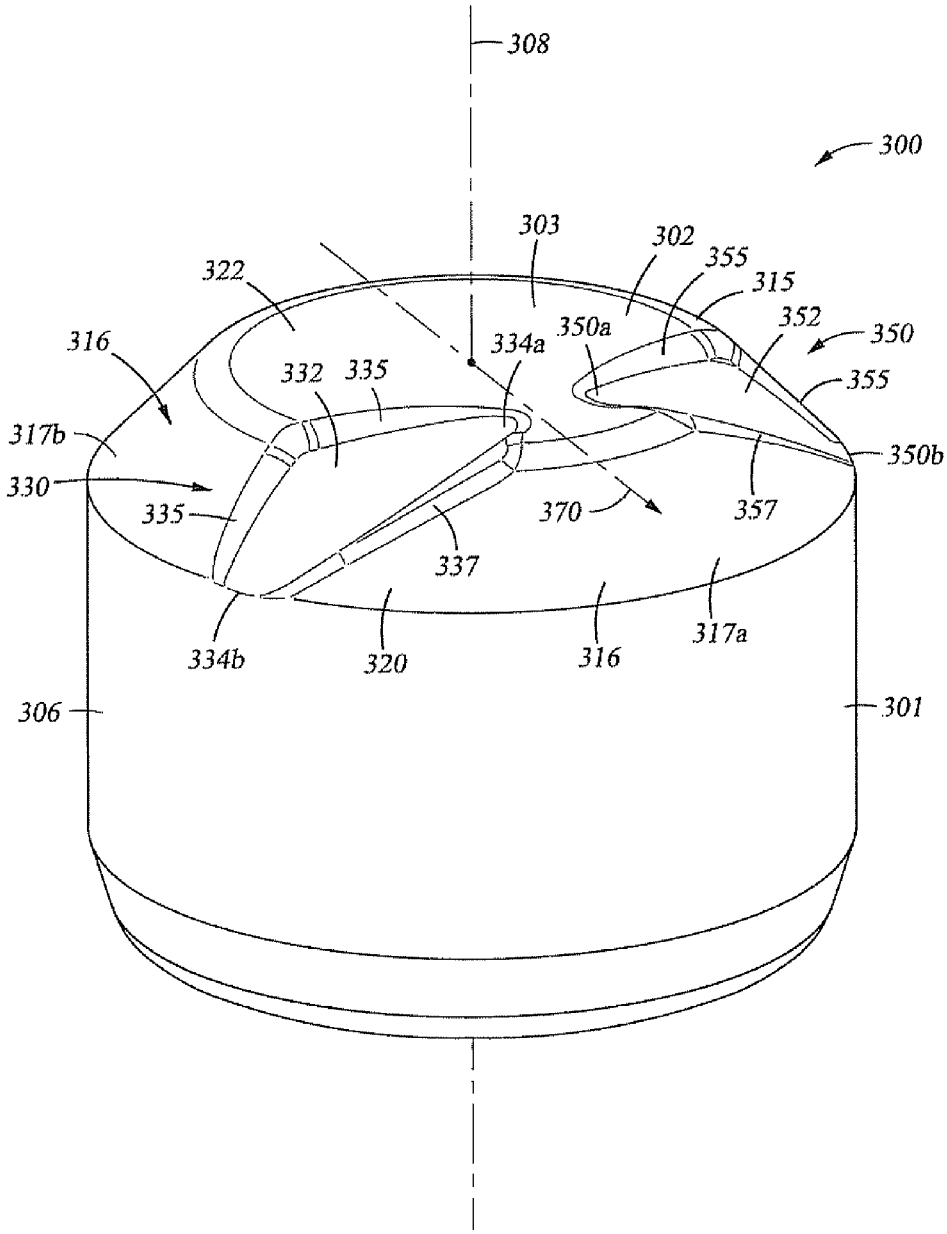
FIG. 7 is a perspective view of an embodiment of a cutting element useful in the drill bit shown in FIGS. 1 and 2.
Figure 8:
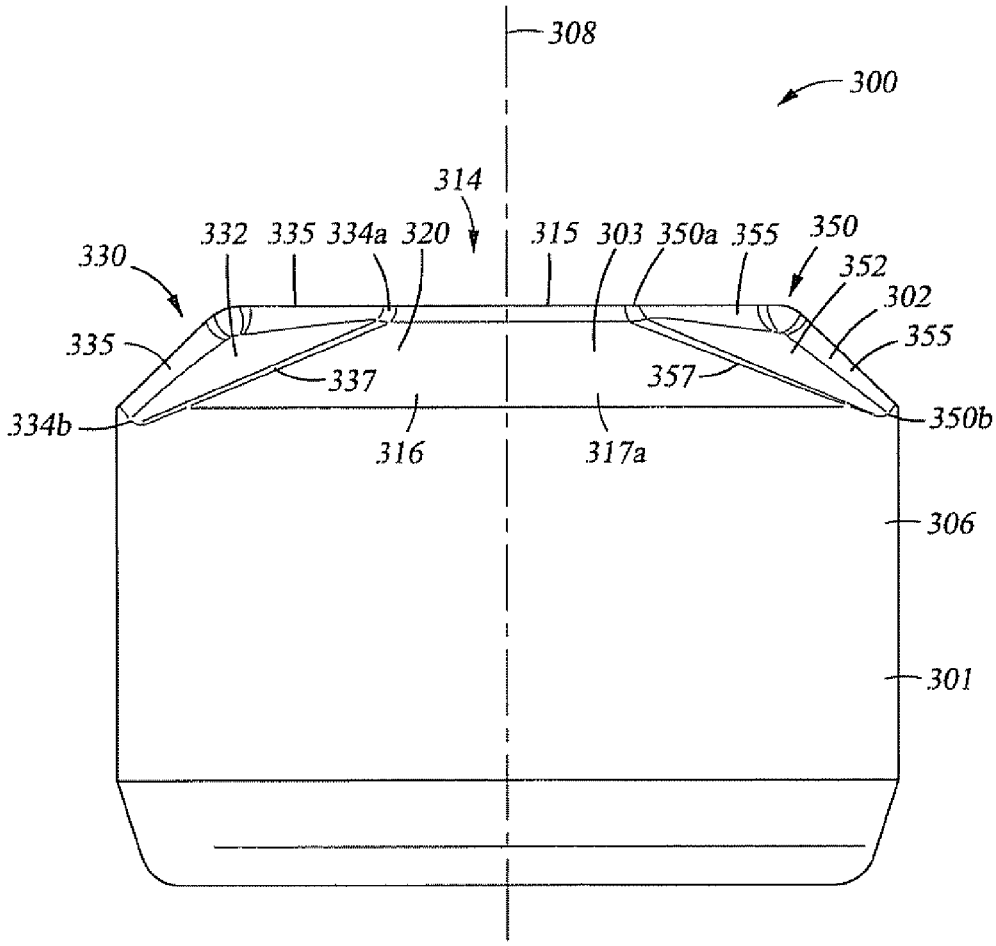
FIG. 8 is a front elevation view of the cutting element shown in FIG. 7.
Figure 9:
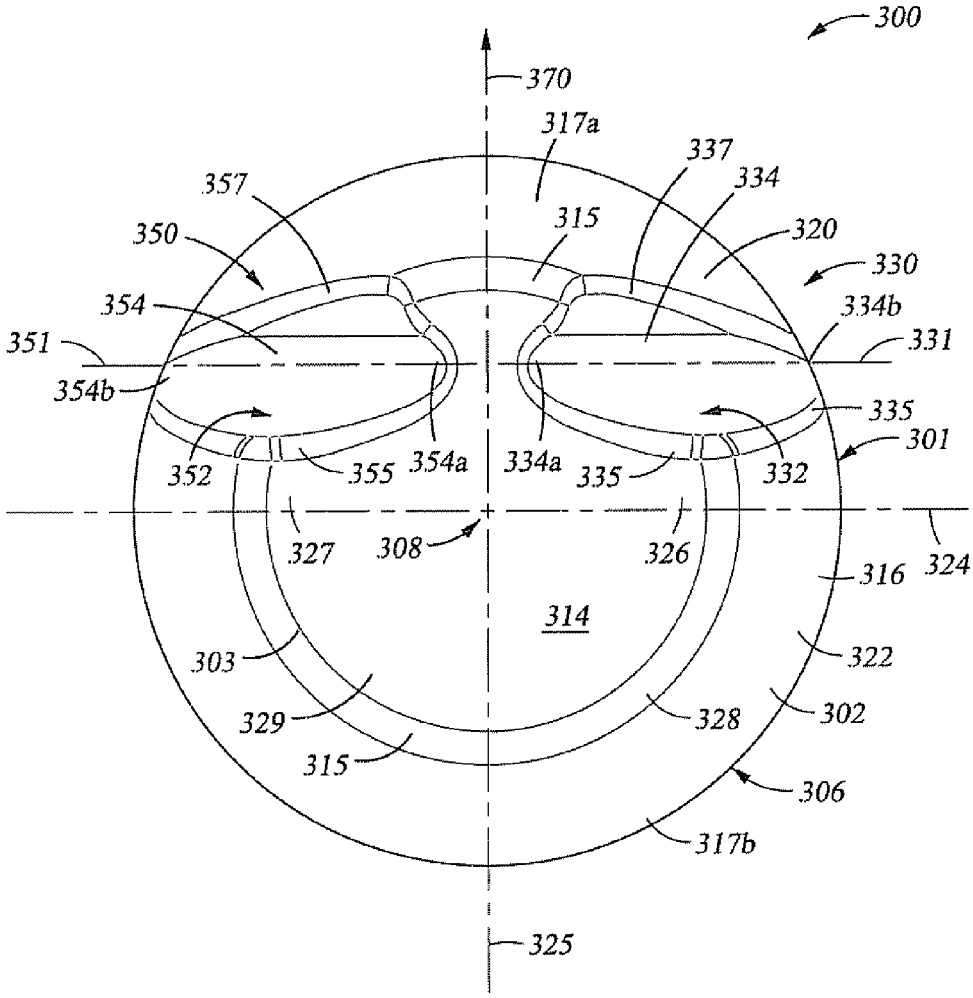
FIG. 9 is a top view of the cutting element shown in FIG. 7.

Referring now to FIGS. 7-9, another embodiment of a cutting element 300 is shown. Insert or cutting element 300 is believed to have particular utility when employed as a heel row insert, such as in heel row 60*a* shown in FIGS. 1 and 2 above. However, cutting element 300 may also be employed in other rows and other regions on the cone cutter, such as in gage rows 70*a*, 70*b* and inner rows 81*a*, 82*a* shown in FIGS. 1 and 2.

Cutting element or insert 300 includes a base portion 301 and a cutting portion 302 having a cutting surface 303 extending therefrom to the extension height of insert 300. Base portion 301 is generally cylindrical, having a central axis 308 and an outer surface 306.

Similar to cutting surface 103 of insert 100 previously described, cutting surface 303 of insert 300 includes a generally planar upper or top surface 314 (e.g., substantially flat top) and a generally frustoconical beveled or chamfered surface 316 disposed between upper surface 314 and cylindrical outer surface 306 of base portion 301. Flat upper surface 314 is substantially perpendicular to axis 308 and defines the extension height of insert 300. Beveled surface 316 preferably has a bevel angle between 15° and 75°, and more preferably between 30° and 65°. Further, a radiused transition surface 315 disposed between beveled surface 316 and upper surface 314. Transition surface 315 preferably has a radius of curvature between 0.010 in. and 0.040 in., and more preferably between 0.020 in. and 0.030 in.

A particular orientation for cutting element 300 when positioned in a rolling cone cutter is described more fully below. In certain embodiments, insert 300 is positioned in the cone cutter such that it initially impacts or engages the formation in the general direction represented by arrow 370. Consequently, as best shown in FIG. 9, insert 300 may be divided into a leading side 320 and a trailing side 322 by a first reference plane 324 parallel to and passing through axis 308. Insert 300 may further be divided into quadrants—leading quadrants 326, 327 and trailing quadrants 328, 329 by a second reference plane 325 substantially perpendicular to reference plane 324 and also passing through base axis 308.

Referring still to FIGS. 7-9, a first cutout or edge-creating notch 330 and a second cutout or notch 350 are provided in cutting portion 302. Notches 330, 350 are generally opposed across plane 325. In this embodiment, notches 330, 350 are essentially mirror images of each other across plane 325. In general, notches 330, 350 are substantially the same as notch 130 previously described. Notches 330, 350 are each positioned on the leading side 320 of insert 300, notch 130 in leading quadrant 326 and notch 350 in leading quadrant 327. Further, notches 330, 350 each extend longitudinally along a substantially straight or linear median line 331, 351, respectively, in the top view shown in FIG. 9. Median lines 331, 351 are each generally parallel to reference plane 324 but slightly offset, to the leading side, from first reference plane 324.

Each notch 330, 350 includes a forward facing formation engaging surface 332, 352, respectively, and a lower or bottom surface 334, 354, respectively. Bottom surfaces 334, 354 defines the depth of notches 330, 350, respectively. In addition, notches 330, 350 and associated bottom surfaces 334, 354, respectively, may be described as extending between an inner or first end 334*a*, 354*a*, respectively, proximal reference plane 325 and an outer or second end 334*b*, 354*b*, respectively, disposed at the outer periphery of insert 300. In this embodiment, notches 330, 350 do not cross each other, and further, first ends 334*a*, 354*a* do not intersect. Consequently, notches 330, 350 do not cut completely across upper planar surface 314.

In this embodiment, first ends 334*a*, 354*a* are axially positioned at planar surface 314, and second ends 334*b*, 354*b* are positioned at the intersection of outer cylindrical surface 306 and beveled surface 31. Thus, each notch 330, 350 may be described as piercing or passing through a portion of planar surface 314 and beveled surface 316.

The depth of each notch 330, 350 varies along its length. In particular, the depth of each notch 330, 350 generally increases moving from first end 334*a*, 354*a*, respectively, towards second end 334*b*, 354*b*, respectively. In other words, depth of notches 330, 350 are least at first end 334*a*, 354*b*, respectively, and greatest at second end 334*b*, 354*b*, respectively. At first ends 334*a*, 354*a*, the depth of notches 330, 350, respectively, is about zero since first ends 334*a*, 354*a* are coincident with planar surface 314. At second ends 334*b*, 354*b*, the depth of notches 330, 350, respectively, are each about equal to the extension height of insert 300. Consequently, notches 330, 350 each pierce beveled surface 316 and interrupt the annular continuity of beveled surface 316. In this sense, beveled surface 316 may be described as comprising a relatively short forward segment 317*a* positioned between notches 330, 350 on leading side 320, and a relatively long rearward segment 317*b* positioned between notches 330, 350 on trailing side 322.

Referring still to FIGS. 7-9, formation engaging surfaces 332, 352 of notches 330, 350, respectively, each intersect with planar surface 314 and rearward segment 317*b* of beveled surface 316 to form a distinct continuous trailing cutting edge 335, 355, respectively. Further, each notch 330, 350 forms a leading cutting edge 337, 357, respectively, with forward segment 317*a* of beveled surface 316. Leading cutting edges 337, 357 are continuous with transition surface 315, and thus, the combination of leading cutting edges 337, 357 and transition surface 315 form one continuous leading cutting edge.

In the front view of FIG. 8, trailing cutting edges 335, 355 extend generally along planar surface 314 and then along rearward segment 317*b* of beveled surface 316 between first ends 334*a*, 354*a*, respectively, and second ends 334*b*, 354*b*, respectively. Leading cutting edges 337, 357 generally slope down and away from planar surface 314 as they extend from first end 334*a*, 354*a*, respectively, to second ends 334*b*, 354*b*, respectively. As a result of this configuration and orientation, leading cutting edges 337, 357 are axially disposed below trailing cutting edges 335, 355, respectively. Consequently, formation engaging surfaces 332, 352 and associated cutting edges 335, 355, respectively, are visible when viewed along the impact direction 370 perpendicular to axis 308.

Each cutting edge 335, 355, 337, 357 is preferably radiused to reduce the likelihood of chipping and cracking of insert 300 as previously described. In particular, each cutting edge 335, 355, 337, 357 preferably has a radius of curvature between 0.010 in. and 0.040 in., and more preferably between 0.020 in. and 0.030 in.

Thus, the embodiment of cutting element 300 shown in FIGS. 7-9 is substantially the same as cutting element 100 previously described with reference to FIGS. 3-5 with the primary exception being that cutting surface 303 of cutting element 300 includes two notches 330, 350 as compared to the single notch 130 in cutting surface 103 of cutting element 100 (FIGS. 3-5). Consequently, embodiments of cutting element 300 provide no less than three distinct cutting surfaces (e.g., formation engaging surfaces 332, 352, and forward segment 317*a* of beveled surface 316) and three distinct cutting edges (e.g., leading cutting edges 337, 357 continuous with transition surface 315, and trailing cutting edges 335, 355). Thus, embodiments of cutting element 300 provide an additional cutting surface and an additional cutting edge as compared to cutting element 100 previously described, and at least two additional cutting surfaces and at least two additional cutting edges as compared to the conventional prior art cutting element 200 previously described. As with insert 100 previously described, it is believed that embodiments of insert 300 offer the potential for efficient formation removal and desirable ROP.

Figure 10:
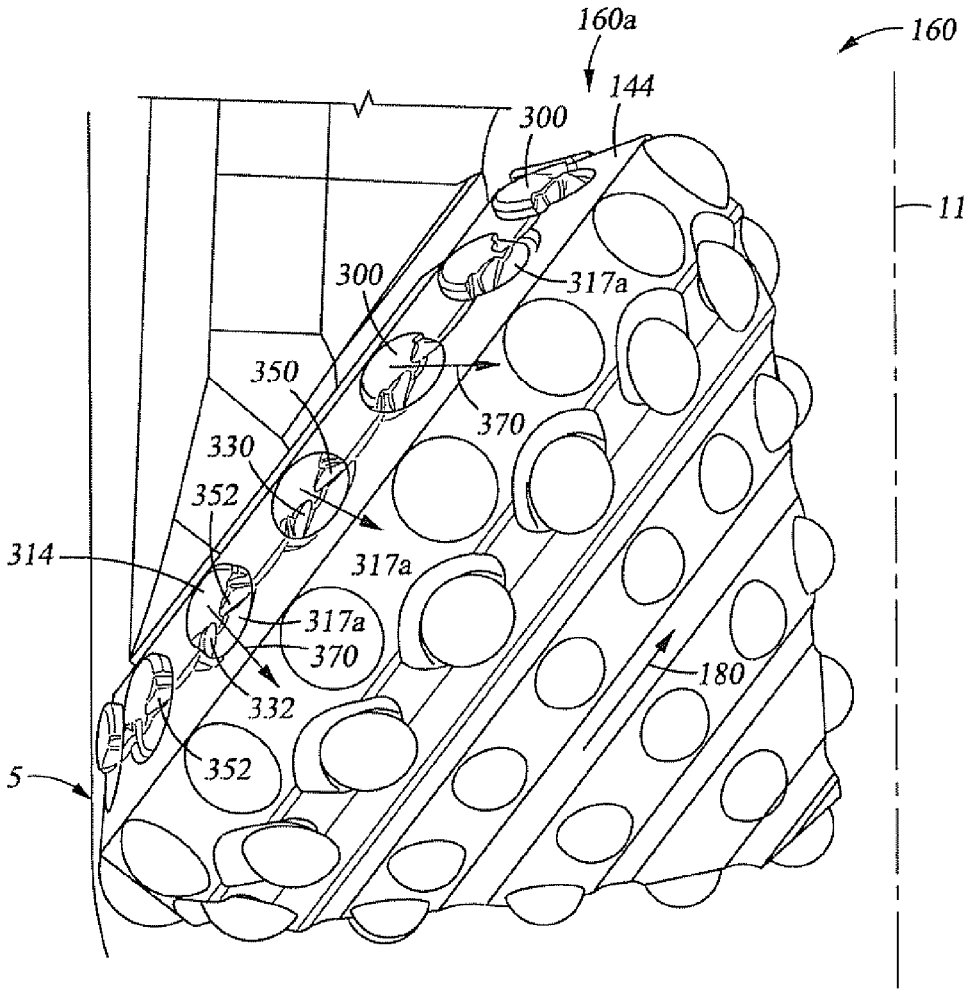
FIG. 10 is a partial perspective view of the cutting element shown in FIGS. 7-9 as mounted in a rolling cone drill bit.

Embodiments of the inserts designed in accordance with the principals described herein (e.g., insert 100, 300) may be mounted in various places in a rolling cone cutter. FIG. 10 depicts an embodiment of insert 300 mounted in an exemplary location in rolling cone cutter 160 as may be employed, for example, in bit 10 described above with reference to FIGS. 1 and 2, with cone cutter 160 substituted for any of the cones 1-3 previously described. In particular, cone cutter 160 includes a plurality of inserts 300 disposed in a circumferential heel row 160*a* on frustoconical heel surface 144. In this embodiment, cutting elements 300 are press-fit into mating sockets in the heel surface 144 to a depth such that cutting portion 302 and cutting surface 303 extend to full gage diameter. In particular, inserts 300 are positioned to engage and ream the borehole sidewall 5, thereby maintaining a full gage borehole. Other locations and orientations may be employed.

Figure 11:
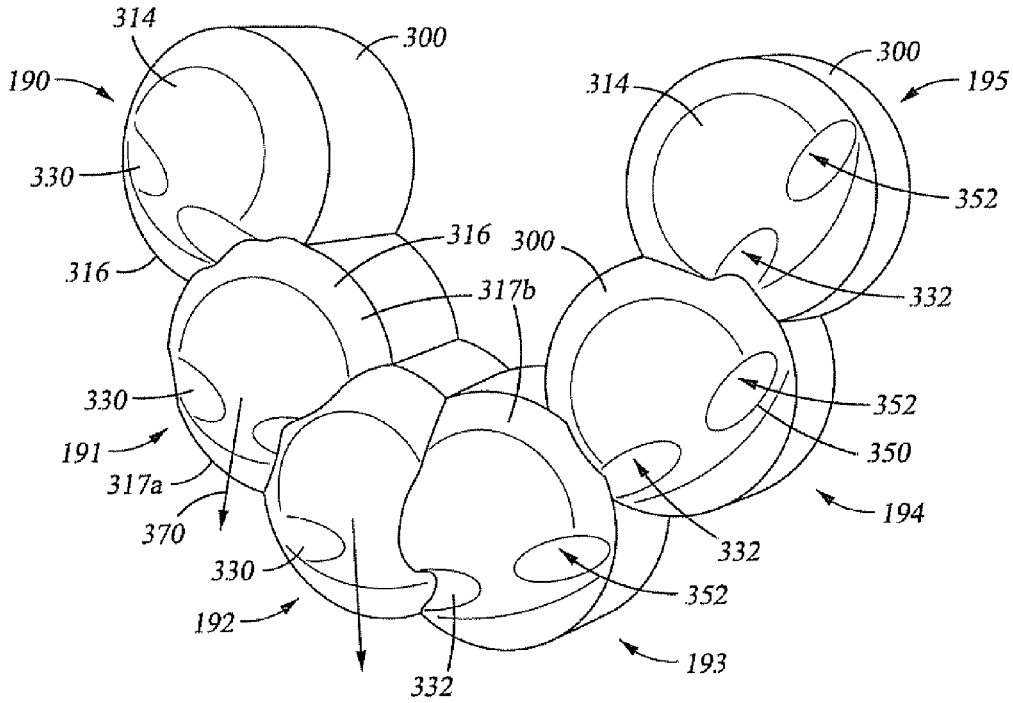
FIG. 11 is an enlarged, schematic view showing one of the heel row cutting elements shown in FIG. 10 as the cutting element approaches, engages, and moves away from the borehole sidewall.

Referring now to FIGS. 10 and 11, a schematic view illustrating the simulated movement of an exemplary insert 300 provided in rolling cone 160 (FIG. 10) is shown. In particular, six selected positions 190-195 of insert 300 as it approaches, engages, and departs from borehole sidewall 5 are shown. It is to be understood that positions 190-195 generally occur when insert 300 is at its lowermost position during rotation of cone 160 (i.e., at its greatest distance from bit axis 11).

As exemplary insert 300 sweeps through the path shown in FIG. 11, the orientation of notches 330, 350 and formation engaging cutting surfaces 332, 352, respectively, relative to borehole sidewall 5, vary from position to position—the complex motion of inserts 300 results in the apparent twisting or rotation of insert 300 relative to borehole sidewall 5. Consequently, segment 317*a* of beveled surface 316 and notches 330, 350 are not always positioned on the leading side 320 of insert 300.

As understood with reference to FIGS. 10 and 11, as cone cutter 160 rotates in the borehole, each insert 300 periodically approaches, impacts, engages, and then leaves the borehole sidewall 5. During its approach toward borehole sidewall 5 (position 190), insert 300 has not yet contacted the formation and is generally moving in a downward direction towards sidewall 5. Insert 300 will continue its general downward approach and eventually impact or strike borehole sidewall 5 (position 191). Insert 300 impacts borehole sidewall 5 with an instantaneous direction of strike represented by arrow 370. As best shown in position 191, as insert 300 strikes borehole sidewall 5, segment 317*a* of beveled surface 316 first impacts the formation followed by formation engaging surfaces 332, 352 of notches 330, 350. In other words, segment 317*a* and notches 330, 350 are all on the leading side of insert 300, with notches 330, 350 trailing segment 317*a*. Further, formation engaging surfaces 332, 352 are each forward facing relative to borehole sidewall 5. As previously described, in such an orientation, it is believed the cutting efficiency of insert 300 is enhanced.

Following the initial impact with borehole sidewall 5, insert 300 continues its general downward cutting path through the formation (position 192), with segment 317*a* of beveled surface 316 and notches 330, 350 substantially positioned on the leading side of insert 300. Likewise, formation engaging surfaces 332, 352 generally remain forward facing relative to borehole sidewall 5. However, as insert 300 reaches the bottom of its path and begins to move laterally and back upward (position 193), segment 317*a* and notches 330, 350 do not each remain substantially on the leading side of insert 300, and further, formation engaging surfaces 332, 335 are no longer forward facing. Rather, after insert 300 has reached its lowermost position (position 193), the bulk of formation shearing and removal is performed by segment 317*b* of beveled surface 316. As insert 300 continues its path through the formation (positions 192 and 193), planar surface 314 generally slides across the newly exposed portion of borehole sidewall 5 resulting, at least in part, by the shearing, cutting, and reaming by beveled surface 316 and formation engaging surfaces 332, 352.

Insert 300 continues its generally upward movement out of the formation at borehole sidewall 5 (position 194) and eventually moves away from and no longer engages borehole sidewall 5 (position 194). This general sequence of events is repeated for insert 300 each time rolling cone cutter 160 makes a complete revolution about its axis of rotation. Although the movement of an exemplary insert 300 mounted in the heel row of rolling cone cutter 160 is shown in FIG. 11, it is to be understood that each insert 300 in rolling cone cutter 160 is oriented substantially the same and operates substantially the same as rolling cone cutter 160 rotates.

Referring still to FIGS. 10 and 11, as understood by those in the art, the phenomenon by which formation material is removed by the impacts of cutting elements is extremely complex. The geometry and orientation of the cutting elements, the design of the rolling cone cutters, the type of formation being drilled, as well as other factors, all play a role in how the formation material is removed and the rate that the material is removed (i.e., ROP). In the embodiment of rolling cone cutter 160 shown in FIG. 10, each insert 300 is oriented in cone cutter 160 such that such that each notch 330, 350 and segment 317*a* of beveled surface 316 are each substantially positioned on the leading side 320 of insert 300 upon impact with borehole sidewall 5 (position 191) and during the continued downward movement of insert 300 into the formation (position 192). In addition, each insert 300 is oriented such that formation engaging surfaces 332, 352 are each forward facing upon impact with borehole sidewall 5 (position 191) and during the continued downward movement of insert 300 into the formation (192). As a result, insert 300 presents three distinct cutting faces and three distinct cutting edges to the formation, as previously described. As compared to a rolling cone cutter having a circumferential row of conventional heel row insert (e.g., conventional heel row insert 200), it is believed that embodiments of rolling cone 160 including a circumferential heel row of inserts 300 oriented as shown in FIG. 10 offer the potential for good cutting efficiency and desirable ROP.

Figure 12:
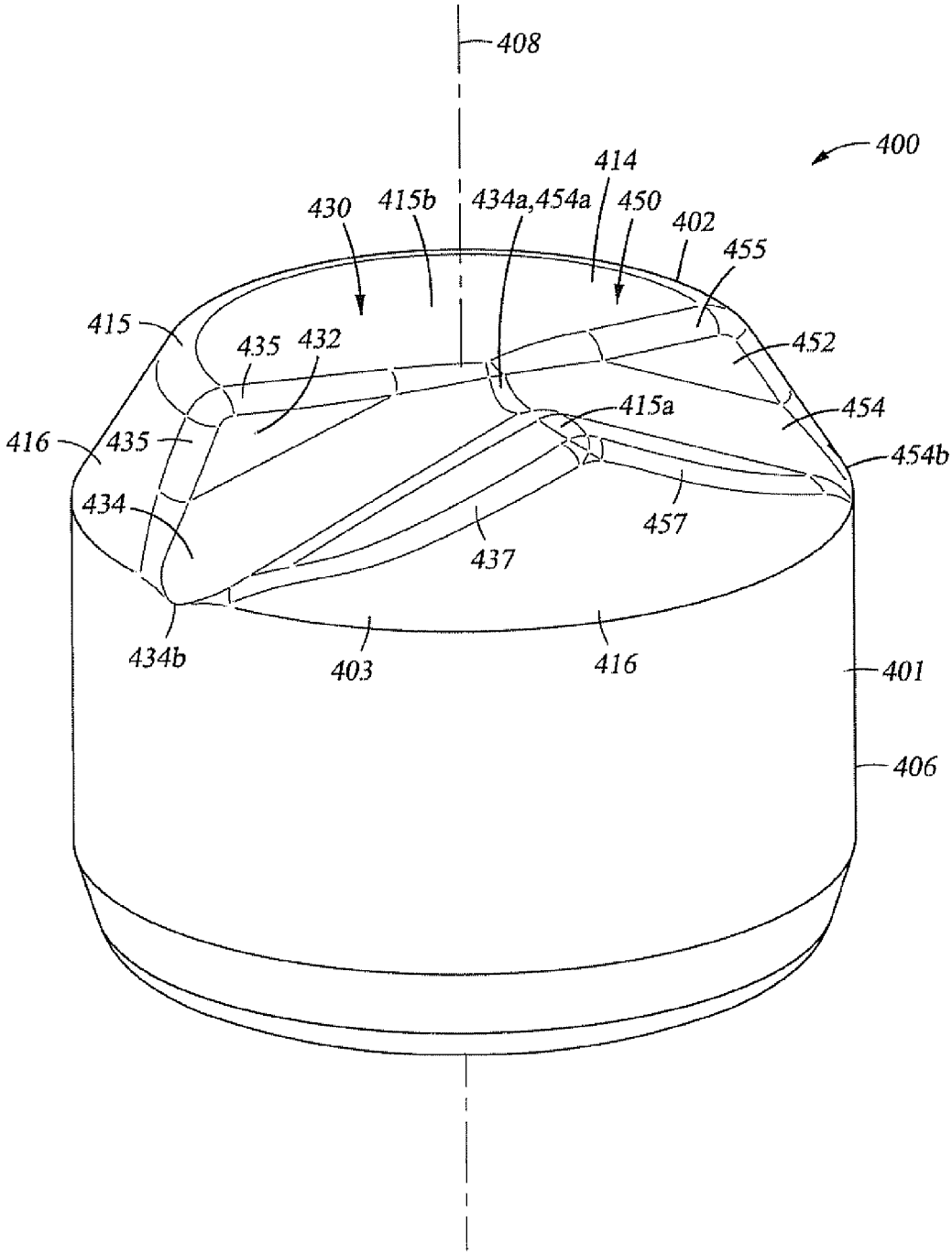
FIG. 12 is a perspective view of an embodiment of a cutting element useful in the drill bit shown in FIGS. 1 and 2.

Referring now to FIG. 12, another embodiment of an insert or cutting element 400 is shown. Cutting element 400 is believed to have particular utility when employed as a heel row insert, such as in heel row 60*a* shown in FIGS. 1 and 2 above. However, cutting element 400 may also be employed in other rows and other regions on the cone cutter, such as in gage rows 70*a*, 70*b* and inner rows 81*a*, 82*a* shown in FIGS. 1 and 2.

Cutting element or insert 400 is substantially the same as cutting element 300 previously described. Namely, cutting element 400 includes a base portion 401 and a cutting portion 402 having a cutting surface 403 extending therefrom to the extension height of insert 400. Base portion 401 has a central axis 408 and an outer surface 406. Cutting surface 403 includes a generally planar upper or top surface 414 and a generally frustoconical beveled or chamfered surface 416 extending between upper surface 414 and outer surface 406 of base portion 401. A radiused transition surface 415 disposed between beveled surface 416 and upper surface 414.

Similar to insert 300 previously described, cutting portion 402 includes a pair of generally opposed cutouts or notches 430, 450. Notches 430, 450 are each preferably positioned on the leading side of insert 400. Each notch 430, 450 includes a forward facing formation engaging surface 432, 452, respectively, and a generally concave lower surface 434, 454, respectively. Lower surface 434, 454 defines the depth of notch 430, 450, respectively.

Lower surfaces 434, 454 each extend between a first inner end 434*a*, 454*a*, respectively, and a second outer end 434*b*, 454*b*, respectively. The depth of each notch 430, 450 generally increases moving from first end 434*a*, 454*a*, respectively, towards second end 434*b*, 454*b*, respectively. In this embodiment, the depth of each notch 430, 450 at second end 434*b*, 454*b*, respectively, is substantially the same as the extension height of insert 400. Contrary to insert 300 previously described, in this embodiment, first ends 434*a*, 454*a* are not disposed at planar surface 414, but rather, are recessed from planar surface 414. In addition, in this embodiment, notches 430, 450 intersect at first ends 434*a*, 454*a*. In other words, first ends 434*a*, 454*a* share the same position. As a result, notches 430, 450 pass completely through and divide upper planar surface 414 into a first or forward upper surface 415*a* generally on the leading side of notches 430, 450 and a second or rearward upper surface 415*b* generally on the trailing side of notches 430, 450. In this embodiment, upper surfaces 415*a, b* are each planar, generally perpendicular to axis 408, and each substantially disposed at the extension height of insert 400. In other embodiments, upper surfaces 415*a, b* may be disposed at different heights and/or have different geometry (e.g., planar, curved, etc.).

Formation engaging surfaces 432, 452 intersect with rearward upper surface 415*b* and beveled surface 416 form trailing cutting edges 435, 455, respectively. Trailing cutting edges 435, 455 are continuous with each other and generally extend along rearward upper surface 415*b* and beveled surface 416 towards second ends 434*b*, 454*b*, respectively. In addition, each notch 430, 450 forms a leading cutting edge 437, 457, respectively. Leading cutting edges 437, 457 are continuous with each other and generally slope down and away from forward upper surface 415*a* toward second ends 434*b*, 454*b*, respectively. In this sense, leading cutting edges 437, 457 may be described as meeting to form a peak at first upper surface 415*a*.

Figure 13:
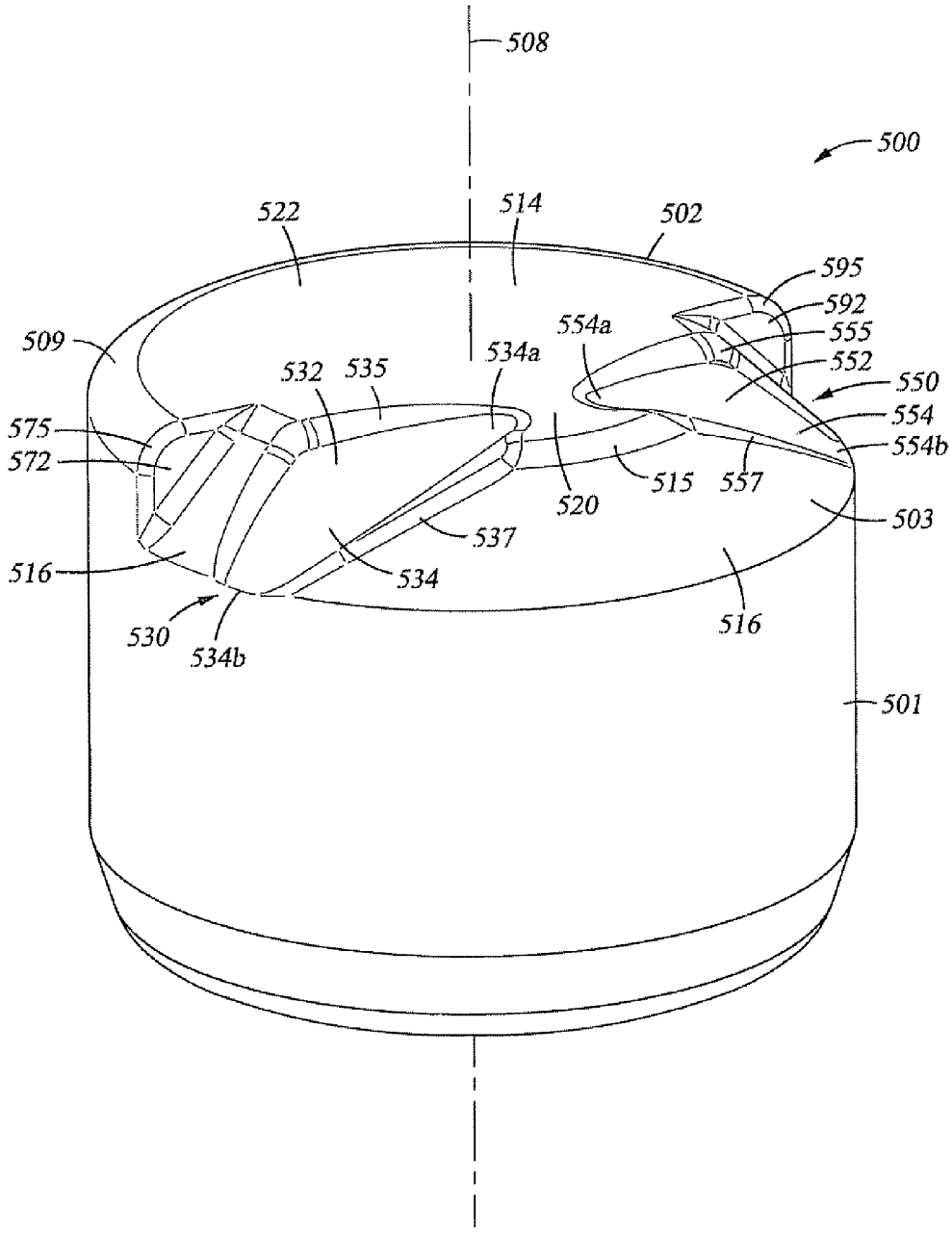
FIG. 13 is a perspective view of an embodiment of a cutting element useful in the drill bit shown in FIGS. 1 and 2.
Figure 14:
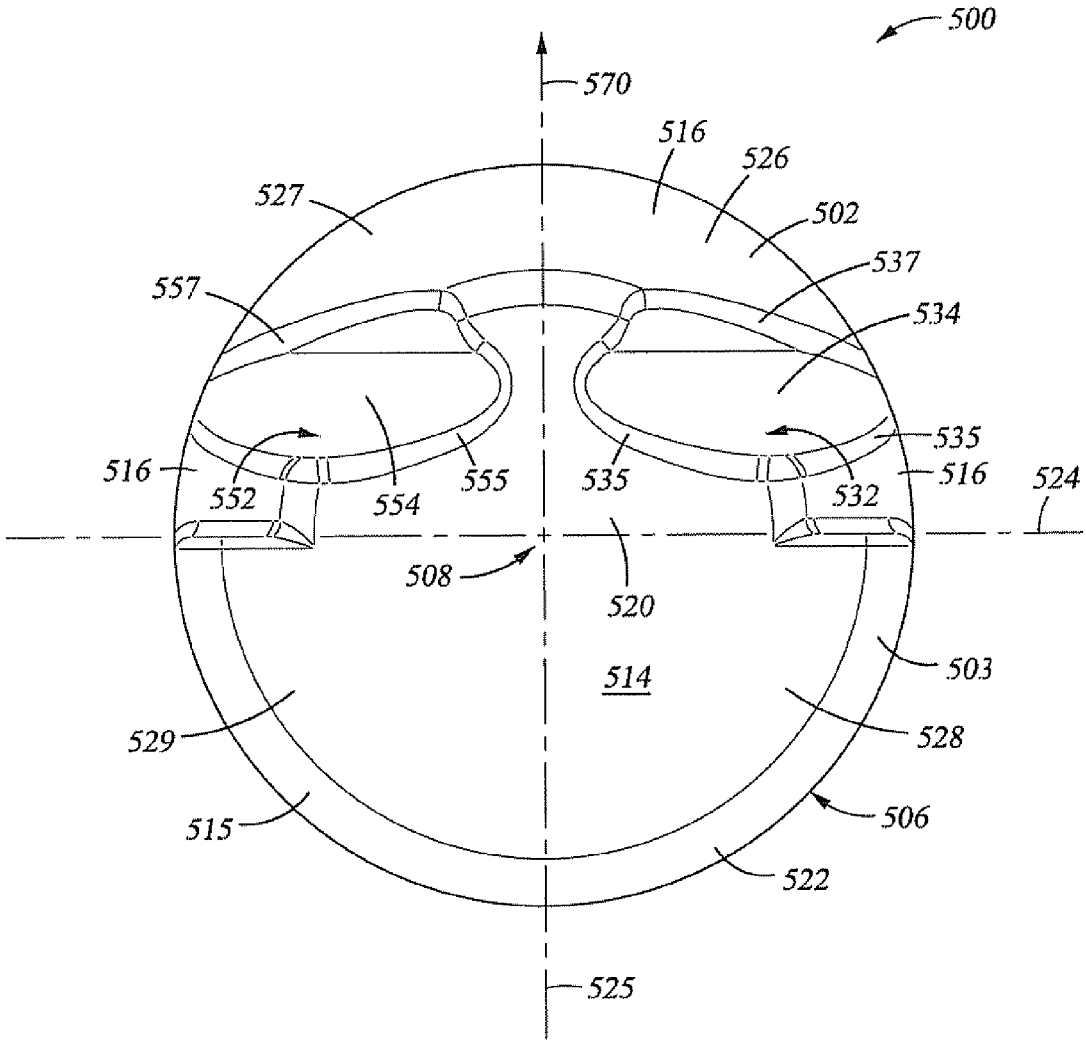
FIG. 14 is a top view of the cutting element shown in FIG. 13.

Referring now to FIGS. 13 and 14, another embodiment of a cutting element 500 is shown. Insert or cutting element 500 is believed to have particular utility when employed as a heel row insert, such as in heel row 60*a* shown in FIGS. 1 and 2 above. However, cutting element 500 may also be employed in other rows and other regions on the cone cutter, such as in gage rows 70*a*, 70*b* and inner rows 81*a*, 82*a* shown in FIGS. 1 and 2.

Cutting element or insert 500 includes a base portion 501 and a cutting portion 502 having a cutting surface 503 extending therefrom to the extension height of insert 500. In this embodiment, base portion 501 is generally cylindrical, having a central axis 508 and an outer surface 506.

Similar to cutting surface 303 of insert 300 previously described, cutting surface 303 of insert 500 includes a generally planar upper or top surface 514 (e.g., flat top). Flat upper surface 514 is substantially perpendicular to axis 508 and defines the extension height of insert 500. In addition, insert 500 includes a frustoconical beveled surface 516 extending between surface 514 and cylindrical outer surface 506. However, unlike insert 300 previously described, beveled surface 516 of insert 500 does not extend 360° around the circumference of cutting portion 502 in top view. Rather, beveled surface 516 extends about 180° around insert 500 in top view. In particular, beveled surface 516 extends only along the leading side 520 of cutting surface 503. In the places on cutting portion 502 where beveled surface 516 is provided, it extends from outer surface 506 of base portion 502 and meets with upper planar surface 514 at a radius transition surface 515. However, where no beveled surface is provided on cutting portion 502, outer cylindrical surface 506 continues into cutting portion 502 until it meets upper planar surface 514 at a radiused transition surface 509. In general, cylindrical outer surface 506 is perpendicular to upper planar surface 514.

Beveled surface 516 preferably has a bevel angle between 15° and 75°, and more preferably between 30° and 65°. Radiused transition surfaces 509, 515 disposed between outer cylindrical surface 506 and upper surface 514, and between beveled surface 516 and upper surface 514, respectively, preferably each have a radius of curvature between 0.010 in. and 0.040 in., and more preferably between 0.020 in. and 0.030 in.

In certain embodiments, insert 500 is positioned in the cone cutter such that it initially impacts or engages the formation in the general direction represented by arrow 570. Consequently, as best shown in FIG. 14, insert 500 may be divided into a leading side 520 and a trailing side 522 by a first reference plane 524 passing through axis 508. Insert 500 may further be divided into quadrants—leading quadrants 526, 527 and trailing quadrants 528, 529 by a second reference plane 525 substantially perpendicular to reference plane 524 and also intersecting base axis 508.

Referring still to FIGS. 13 and 14, a pair of generally opposed cutouts or notches 530, 550 are provided in cutting portion 502. Notches 530, 550 are substantially the same as notches 330, 350 previously described with reference to FIGS. 7-9. Namely, notches 530, 550 each extend longitudinally along a substantially straight or linear median line 531, 551, respectively, that is generally parallel to reference plane 524 but slightly offset, to the leading side, from first reference plane 524.

Each notch 530, 550 comprises a formation engaging surface 532, 552, respectively, and a generally U-shaped lower or bottom surface 534, 554, respectively. Formation engaging surfaces 532, 552 are preferably forward facing. Bottom surfaces 534, 554 extend between an inner or first end 534*a*, 554*a*, respectively, proximal reference plane 525 and an outer or second end 534*b*, 554*b*, respectively, disposed at the outer periphery of insert 500. First ends 534*a*, 554*a* are axially positioned at planar surface 514, and second ends 534*b*, 554*b* are positioned at the intersection of outer cylindrical surface 506 and beveled surface 516. The depth of notches 530, 550 generally increases moving from first end 534*a*, 554*a*, respectively, towards second end 534*b*, 554*b*, respectively. In particular, at second ends 534*b*, 554*b*, the depth of notches 530, 550, respectively, are each about equal to the extension height of insert 500.

Notches 530, 550 form leading cutting edges with beveled surface 416 and trailing cutting edges with planar surface 514 and beveled surface 516. More specifically, formation engaging surfaces 532, 552 intersects with planar surface 514 and beveled surface 516 to form distinct continuous cutting edges 535, 555, respectively. Trailing cutting edges 535, 555 extend generally along planar surface 514 and beveled surface 516 between first ends 534*a*, 554*a* and second ends 534*b*, 554*b*, respectively. Leading cutting edges 537, 557 generally slope down and away from planar surface 514 as each extends from first end 534*a*, 554*a* to second ends 334*b*, 354*b*, respectively. As a result of this configuration and orientation, leading cutting edges 537, 557 are axially disposed below trailing cutting edges 535, 555, respectively. Consequently, formation engaging surfaces 532, 552 and associated cutting edges 535, 555, respectively, are visible when viewed along the impact direction 570 perpendicular to axis 508. Each cutting edge 335, 355, 537, 557 is preferably radiused to reduce the likelihood of chipping and cracking of insert 500.

Cutting portion 502 of insert 500 further comprises formation engaging surfaces 572, 592, each extending extend between beveled surface 416 and upper planar surface 514 and outer cylindrical surface 506, and each trailing notches 530, 550, respectively. In this embodiment, formation engaging surfaces 572, 592 are angularly spaced about 180° apart, each is substantially parallel to plane 524 and perpendicular to plane 570, and each is forward facing relative to the impact direction 570. Formation engaging surfaces 572, 592 each intersect with upper planar surface 514 and outer cylindrical surface 506 at substantially 90°. A cutting edge 575, 595 is formed at the intersection of each formation engaging surface 572, 592 and upper surface 516 and outer cylindrical surface 506. In this embodiment, cutting edges 575, 595 are each radiused.

Thus, the embodiment of cutting element 500 shown in FIGS. 13 and 14 is substantially the same as cutting element 300 previously described with reference to FIGS. 7-9 with the primary exception that cutting surface 503 of cutting element 500 includes two additional formation engaging surfaces 572, 592. Consequently, embodiments of cutting element 500 provide no less than five distinct cutting surfaces (e.g., beveled surface 516 and formation engaging surfaces 532, 552, 572, 592) and three distinct cutting edges (e.g., cutting edges 535, 555, 575, 595 and transition surface 515). Thus, embodiments of cutting element 500 provide an additional cutting surfaces and cutting edges as compared to cutting element 300 previously described, and at least four additional cutting surfaces and cutting edges as compared to the conventional prior art cutting element 200 previously described. Consequently, it is believed that embodiments of insert 500 offer the potential for efficient formation removal and desirable ROP.

Figure 15:
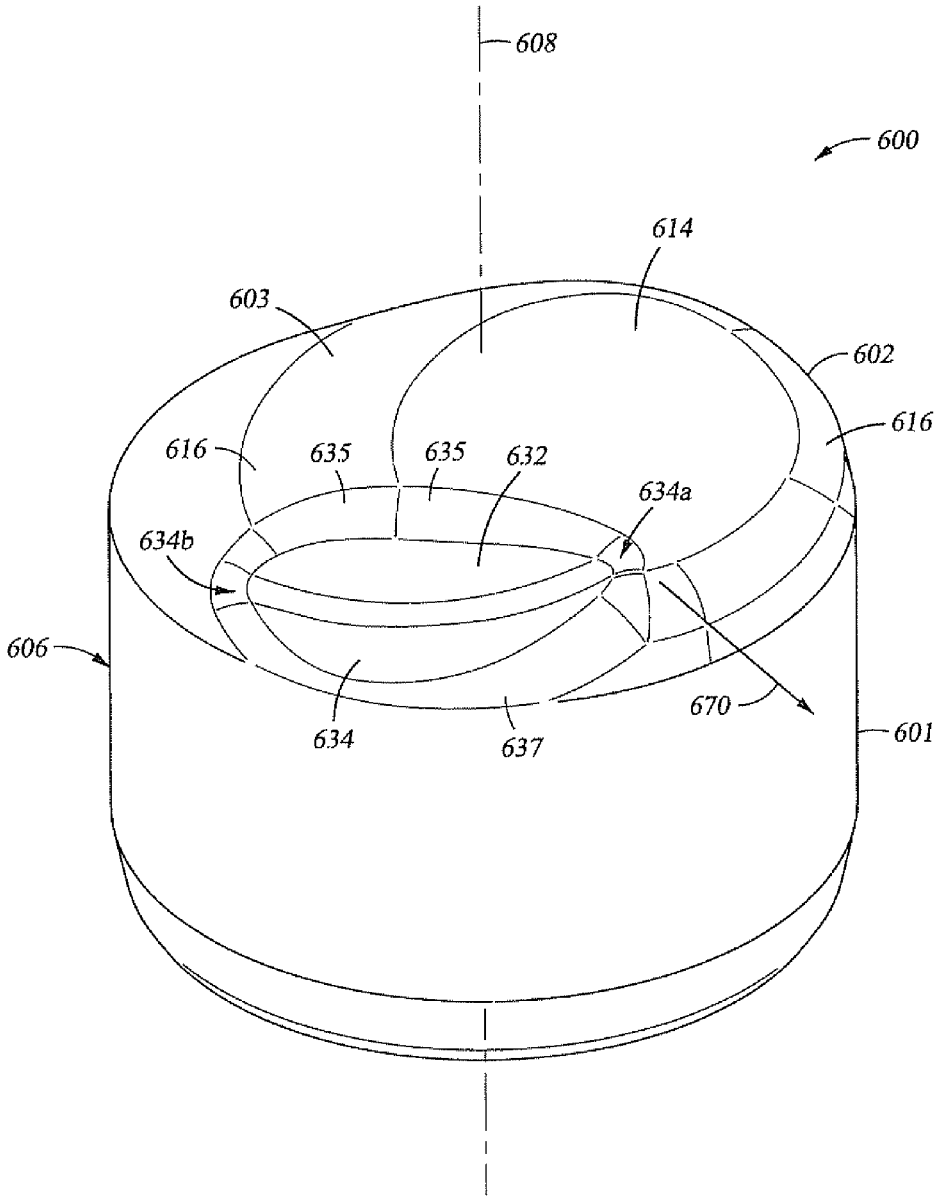
FIG. 15 is a perspective view of an embodiment of a cutting element useful in the drill bit shown in FIGS. 1 and 2.

Referring now to FIG. 15, another embodiment of an insert or cutting element 600 is shown. Cutting element 600 is believed to have particular utility when employed as a heel row insert, such as in heel row 60*a* shown in FIGS. 1 and 2 above. However, cutting element 600 may also be employed in other rows and other regions on the cone cutter. Cutting element 600 is preferably oriented in the rolling cone cutter such that has an initial strike or impact direction 670.

Cutting element or insert 600 includes a base portion 601 and a cutting portion 602 having a cutting surface 603 extending therefrom to the extension height of insert 600. Base portion 601 has a central axis 608 and an outer cylindrical surface 606. Cutting surface 603 includes a generally planar upper or top surface 614 and an annular radiused transition surface 616 extending between upper surface 614 and outer cylindrical surface 606. In this embodiment, transition surface 616 has a non-uniform radius of curvature. In particular, the radius of curvature of transition surface 616 varies from about 0.015 in. to 0.030 in. on the leading side of insert 600 (i.e., proximal impact direction 670) to about 0.015 in. to 0.030 in. on the trailing side of insert 600. Still further, in this embodiment, a frustoconical bevel is not included between upper surface 614 and cylindrical surface 606 of base portion 601.

Cutting portion 602 includes an indentation 630 formed in planar surface 614. Indentation 630 is preferably positioned on the leading side of insert 600 relative to the direction of strike or initial impact 670. In this embodiment, indentation 630 is a relatively smoothly curved ovoid or oval shaped concavity, and thus, may also be referred to herein as scoop or depression 630. Depression 630 extends across a portion of upper surface 614 and completely across transition surface 616, thereby interrupting the continuation of annular transition surface 616.

Depression 630 includes a forward-facing formation engaging surface 632 and a concave lower surface 634 that defines the depth of depression 630 as measured perpendicularly from the plane including upper surface 614. Lower surface 634 includes a first end 634*a* proximal upper planar surface 614 and a second end 634*b* disposed at annular transition surface 616, generally distal upper planar surface 614. The depth of depression 630 at second end 634*b* is greater than the depth of depression 630 at first end 634*a*, however, the depth of depression 630 does not change uniformly therebetween. In particular, the depth of depression 630 is greatest at a point between first end 634*a* and second end 634*b*.

Formation engaging surface 632 of depression 630 intersects with upper surface 614 and transition surface 616 to form a continuous trailing cutting edge 635. Trailing cutting edge 635 extends from first end 634*a* along upper surface 614 and transition surface 616 towards second ends 634*b*. In addition, lower surface 634 of depression 630 intersects with transition surface 616 to form a continuous leading cutting edge 637. Leading cutting edge 637 extends from first end 634*a* along transition surface 616 toward second end 634*b*. In this embodiment, both trailing cutting edge 635 and leading cutting edge 637 are radiused. More specifically, cutting edges 635, 637 preferably have a radius of curvature between 0.015 in. and 0.030 in.

Referring still to FIG. 15, leading cutting edge 637 generally curves down and away from upper surface 614 as it extends from first end 634*a* to second end 634*b*, while trailing cutting edge 635 is disposed generally along planar surface 614 for a distance and then slopes down and away from upper surface 614 along the portion of transition surface 616 having the greatest radius of curvature as it extends from first end 634*a* to second end 634*b*. As a result of this orientation, leading cutting edge 637 is positioned below trailing cutting edge 635, and forward facing formation engaging surface 632 is visible when insert 600 is viewed along strike or initial impact direction 670 and perpendicular to axis 608. In other words, when insert 600 initially strikes the formation in the direction of arrow 670, formation engaging surface 632 is presented to the formation. Thus, upon impact with the formation, embodiments of insert 600 presents no less than two distinct cutting surfaces and two distinct cutting edges to the formation. More specifically, transition surface 616 on the leading side of insert 600 and formation engaging surface 632 of depression 630 present distinct cutting surfaces to the formation upon impact, and cutting edges 637, 635 present distinct cutting edges to the formation. Thus, embodiments of cutting element 600 provide an additional cutting surface and cutting edge as compared to the conventional prior art cutting element 200 previously described. Consequently, it is believed that embodiments of insert 600 offer the potential for efficient formation removal and desirable ROP.

Figure 16:
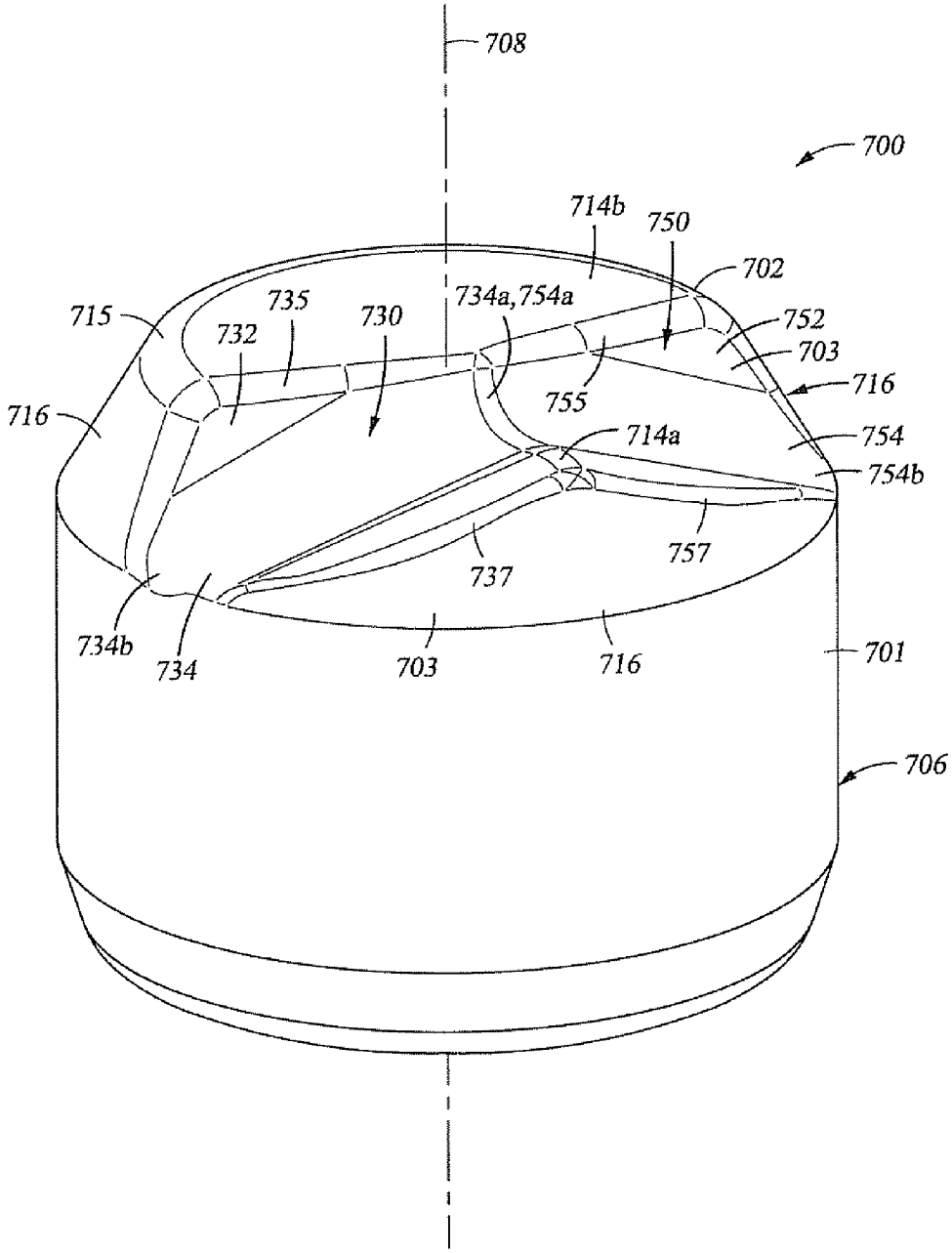
FIG. 16 is a perspective view of another embodiment of a cutting element useful in the drill bit shown in FIGS. 1 and 2.

Referring now to FIG. 16, another embodiment of an insert or cutting element 700 is shown. Cutting element 700 is believed to have particular utility when employed as a heel row insert, such as in heel row 60*a* shown in FIGS. 1 and 2 above. However, cutting element 700 may also be employed in other rows and other regions on the cone cutter, such as in gage rows 70*a*, 70*b* and inner rows 81*a*, 82*a* shown in FIGS. 1 and 2.

Cutting element or insert 700 is similar to cutting element 400 previously described, with the primary exception being that the leading portion of cutting element 700 has a lower extension height than the trailing portion of cutting element 700. Namely, cutting element 700 includes a base portion 701 and a cutting portion 702 having a cutting surface 703 extending therefrom. Base portion 701 has a central axis 708 and an outer surface 706. Cutting surface 703 includes a generally planar first upper surface 714*a*, a generally planar second upper surface 714*b*, and a generally frustoconical beveled or chamfered surface 716 extending between upper surfaces 4714*a, b* and outer surface 706 of base portion 701. Cutting element 700 is preferably positioned in a drill bit such that first surface 714*a* generally leads second surface 714*b* when cutting element 700 impacts the formation. A radiused transition surface 715 disposed between beveled surface 716 and upper surfaces 714*a, b*.

Cutting portion 702 includes a pair of generally opposed cutouts or notches 730, 750. Notches 730, 750 are each preferably positioned on the leading side of insert 700 when insert 700 is positioned in a drill bit. Each notch 730, 750 includes a forward facing formation engaging surface 732, 752, respectively, and a generally concave lower surface 734, 754, respectively. Lower surface 734, 754 defines the depth of notch 730, 750, respectively. Lower surfaces 734, 754 each extend between a first inner end 734*a*, 754*a*, respectively, and a second outer end 734*b*, 754*b*, respectively. The depth of each notch 730, 750 generally increases moving from first end 734*a*, 754*a*, respectively, towards second end 734*b*, 754*b*, respectively.

Formation engaging surfaces 732, 752 intersect with second upper surface 714*b* and beveled surface 716 form continuous cutting edges 735, 755, respectively. In addition, each notch 730, 750 forms a leading cutting edge 737, 757, respectively. Leading cutting edges 737, 757 are continuous with each other and generally slope down and away from first upper surface 714*a* toward second ends 734*b*, 754*b*, respectively.

In this embodiment, upper surfaces 714*a, b* are each planar and lie within planes generally perpendicular to axis 708. However, upper surfaces 714*a, b* are not disposed at the same extension height. Rather, first upper surface 714*a* is disposed at first extension height, and second upper surface 714*b* is disposed at a second extension height that is greater than the first extension height of first upper surface 714*a*. Consequently, when insert 700 is positioned in the drill bit such that first upper surface 714*a* is leading, the leading cutting edges 737, 757 and the portion of beveled surface 716 therebetween will impact and penetrate the formation to a first depth, while trailing cutting edges 735, 755 and forward-facing formation engaging surfaces 732, 752 will impact and penetrate the formation to a second depth that is greater than the first depth.

Without being limited by this or any particular theory, the greater the depth of formation penetration, the greater the impact forces exerted on the engaging and cutting surfaces. Consequently, it may be advantageous to provide sufficient insert material directly behind those portion of an insert that penetrate the formation to the greatest extent to withstand such impact forces. Further, it may be advantageous to position those region of the insert with limited supporting insert material at a lower extension height to reduce impact forces, thereby protecting such regions of the insert. Referring again to insert 700 shown in FIG. 16, notches 734, 754 trail leading cutting edges 737, 757 and first upper surface 714*a*. Thus, a limited volume of insert material is available behind trailing cutting edges 737, 757 and first upper surface 714*a* to provide support upon impact. However, a more substantial volume of insert material is provided immediately behind trailing cutting edges 735, 755 and formation engaging surfaces 732, 752. By positioning first upper surface 714*a* at a lower extension height than second upper surface 714*b*, leading cutting edges 737, 757 and first upper surface 714*a* tend to experience reduce impact forces as compared to trailing cutting edges 735, 755 and formation engaging surfaces 732, 752, thereby providing some protection to leading cutting edges 737, 757 and first upper surface 714*a*.

The materials used in forming the various portions of the cutting elements described herein (e.g., inserts 100, 300, 400, 500, etc.) may be particularly tailored to best perform and best withstand the type of cutting duty experienced by that portion of the cutting element. For example, it is known that as a rolling cone cutter rotates within the borehole, different portions of a given insert will lead as the insert engages the formation and thereby be subjected to greater impact loading than a lagging or following portion of the same insert. With many conventional inserts, the entire cutting element was made of a single material, a material that of necessity was chosen as a compromise between the desired wear resistance or hardness and the necessary toughness. Likewise, certain conventional gage cutting elements include a portion that performs mainly side wall cutting, where a hard, wear resistant material is desirable, and another portion that performs more bottom hole cutting, where the requirement for toughness predominates over wear resistance. With the inserts described herein, the materials used in the different regions of the cutting portion can be varied and optimized to best meet the cutting demands of that particular portion.

More particularly, because the beveled surfaces (e.g., beveled surfaces 116, 316) and formation engaging surfaces (e.g., formation engaging surfaces 332, 352) of the inserts described herein will likely experience more force per unit area upon the insert's impact and engagement with the formation, it may be desirable, in certain applications, to form such portions of the inserts' with materials having differing characteristics. In particular, in at least one embodiment, forward facing surfaces on the leading side of insert 100, 300 are made from a tougher, more facture-resistant material and the trailing portions of insert 100, 300 are made from a more abrasion resistant material.

Cemented tungsten carbide is a material formed of particular formulations of tungsten carbide and a cobalt binder (WC—Co) and has long been used as cutting elements due to the material's toughness and high wear resistance. Wear resistance can be determined by several ASTM standard test methods. It has been found that the ASTM B611 test correlates well with field performance in terms of relative insert wear life. It has further been found that the ASTM B771 test, which measures the fracture toughness ($K1_c$) of cemented tungsten carbide material, correlates well with the insert breakage resistance in the field.

It is commonly known that the precise WC—Co composition can be varied to achieve a desired hardness and toughness. Usually, a carbide material with higher hardness indicates higher resistance to wear and also lower toughness or lower resistance to fracture. A carbide with higher fracture toughness normally has lower relative hardness and therefore lower resistance to wear. Therefore there is a trade-off in the material properties and grade selection.

It is understood that the wear resistance of a particular cemented tungsten carbide cobalt binder formulation is dependent upon the grain size of the tungsten carbide, as well as the percent, by weight, of cobalt that is mixed with the tungsten carbide. Although cobalt is the preferred binder metal, other binder metals, such as nickel and iron can be used advantageously. In general, for a particular weight percent of cobalt, the smaller the grain size of the tungsten carbide, the more wear resistant the material will be. Likewise, for a given grain size, the lower the weight percent of cobalt, the more wear resistant the material will be. However, another trait critical to the usefulness of a cutting element is its fracture toughness, or ability to withstand impact loading. In contrast to wear resistance, the fracture toughness of the material is increased with larger grain size tungsten carbide and greater percent weight of cobalt. Thus, fracture toughness and wear resistance tend to be inversely related. Grain size changes that increase the wear resistance of a given sample will decrease its fracture toughness, and vice versa.

As used herein to compare or claim physical characteristics (such as wear resistance, hardness or fracture-resistance) of different cutting element materials, the term "differs" or "different" means that the value or magnitude of the characteristic being compared varies by an amount that is greater than that resulting from accepted variances or tolerances normally associated with the manufacturing processes that are used to formulate the raw materials and to process and form those materials into a cutting element. Thus, materials selected so as to have the same nominal hardness or the same nominal wear resistance will not "differ," as that term has thus been defined, even though various samples of the material, if measured, would vary about the nominal value by a small amount.

There are today a number of commercially available cemented tungsten carbide grades that have differing, but in some cases overlapping, degrees of hardness, wear resistance, compressive strength and fracture toughness. Some of such grades are identified in U.S. Pat. No. 5,967,245, the entire disclosure of which is hereby incorporated by reference.

Embodiments of the inserts described herein (e.g., inserts 100, 300) may be made in any conventional manner such as the process generally known as hot isostatic pressing (HIP). HIP techniques are well known manufacturing methods that employ high pressure and high temperature to consolidate metal, ceramic, or composite powder to fabricate components in desired shapes. Information regarding HIP techniques useful in forming inserts described herein may be found in the book *Hot Isostatic Processing* by H. V. Atkinson and B. A. Rickinson, published by IOP Publishing Ptd., ©1991 (ISBN 0-7503-0073-6), the entire disclosure of which is hereby incorporated by this reference. In addition to HIP processes, the inserts and clusters described herein can be made using other conventional manufacturing processes, such as hot pressing, rapid omnidirectional compaction, vacuum sintering, or sinter-HIP.

Embodiments of the inserts described herein (e.g., inserts 100, 300) may also include coatings comprising differing grades of super abrasives. Super abrasives are significantly harder than cemented tungsten carbide. As used herein, the term "super abrasive" means a material having a hardness of at least 2,700 Knoop (kg/mm$^2$). PCD grades have a hardness range of about 5,000-8,000 Knoop (kg/mm$^2$) while PCBN grades have hardnesses which fall within the range of about 2,700-3,500 Knoop (kg/mm$^2$). By way of comparison, conventional cemented tungsten carbide grades typically have a hardness of less than 1,500 Knoop (kg/mm$^2$). Such super abrasives may be applied to the cutting surfaces of all or some portions of the inserts. In many instances, improvements in wear resistance, bit life and durability may be achieved where only certain cutting portions of inserts 100, 200 include the super abrasive coating.

Certain methods of manufacturing cutting elements with PDC or PCBN coatings are well known. Examples of these methods are described, for example, in U.S. Pat. Nos. 5,766,394, 4,604,106, 4,629,373, 4,694,918 and 4,811,801, the disclosures of which are all incorporated herein by this reference.

Thus, according to these examples, employing multiple materials and/or selective use of superabrasives, the bit designer, and ultimately the driller, is provided with the opportunity to increase ROP, and bit durability.

While preferred embodiments have been shown and described, modifications thereof can be made by one skilled in the art without departing from the spirit or teaching herein. The embodiments described herein are exemplary only and are not limiting. Many variations and modifications of the system and apparatus are possible and are within the scope of the invention. For instance, although embodiments of cutting elements described herein are shown in conjunction with a rolling cone bit, in other embodiments, the cutting elements described herein may be employed in a fixed cutter or drag bit. Accordingly, the scope of protection is not limited to the embodiments described herein, but is only limited by the claims which follow, the scope of which shall include all equivalents of the subject matter of the claims.

What is claimed is:

1. A cutting element for a drill bit comprising:

a base portion having a base axis and an outer surface;

a cutting portion extending from the base portion and having a cutting surface, wherein a first reference plane parallel to and passing through the base axis divides the cutting surface into a leading section and a trailing section;

wherein the cutting surface includes an upper substantially planar surface defining a first extension height and a beveled surface on the leading side disposed between the upper planar surface and the outer surface of the base portion;

a first notch in the leading section of the cutting surface extending at least partially through the upper planar surface and the beveled surface, wherein the first notch includes a forward facing formation engaging surface.

2. The cutting element of claim 1 wherein the beveled surface defines a bevel angle measured between the beveled surface and an extension of the outer surface of the base portion, wherein the bevel angle is between 30° and 60°.

3. The cutting element of claim 2 wherein the first notch further comprises a bottom surface extending between a first end and a second end, wherein the bottom surface defines a depth of the first notch measured perpendicularly from the upper planar surface, and wherein the depth of the first notch at the first end is less than the depth of the first notch at the second end.

4. The cuffing element of claim 3 wherein the depth of the first notch at the second end is substantially the same as the first extension height.

5. The cutting element of claim 4 wherein the depth of the first notch increases linearly from the first end to the second end.

6. The cuffing element of claim 3 wherein the first end of the bottom surface is disposed at the upper planar surface and the second end of the bottom surface is disposed at the outer surface of the base portion.

7. The cuffing element of claim 3 wherein the first notch passes completely through the beveled surface and interrupts the continuity of the beveled surface.

8. The cuffing element of claim 3 wherein the first notch extends along a median line that is substantially linear in top view.

9. The cutting element of claim 8 wherein the median line is substantially parallel to the first plane in top view.

10. The cutting element of claim 3 wherein the forward facing formation engaging surface of the first notch is at least partially parallel to the first plane.

11. The cuffing element of claim 3 wherein the first notch forms a leading cuffing edge with the beveled surface and forms a trailing cuffing edge with the upper planar surface, the trailing cuffing edge being closer to the first reference plane than the leading cutting edge.

12. The cutting element of claim 11 wherein the trailing cuffing edge is formed at the intersection of the forward facing formation engaging surface and the upper planar surface.

13. The cuffing element of claim 12 wherein the leading cutting edge extends down and away from the upper planar surface along the beveled surface.

14. The cuffing element of claim 13 wherein each cutting edge has a radius of curvature between 0.010 in. and 0.040 in.

15. The cuffing element of claim 14 wherein each cutting edge has a radius of curvature between 0.020 in. and 0.030 in.

16. The cutting element of claim 2 further comprising a radiused transition surface positioned between the upper planar surface and the beveled surface.

17. The cutting element of claim 2 further comprising a second notch in the leading section of the cutting surface extending at least partially through the upper planar surface and the beveled surface, wherein the second notch includes a forward facing formation engaging surface.

18. The cutting element of claim 17 wherein a second reference plane passing through the base axis perpendicular to the first reference plane divides the leading section of the cutting surface into a first quadrant and a second quadrant, the first notch disposed in the first quadrant and the second notch disposed in the second quadrant.

19. The cuffing element of claim 18 wherein the second notch is generally opposed the first notch across a second reference plane.

20. The cuffing element of claim 19 wherein the first notch extends along a first median line that is substantially linear in top view, and the second notch extends along a second median line that is substantially linear in top view.

21. The cuffing element of claim 20 wherein the first median line and the second median line are each parallel to the first reference plane in top view.

22. The cutting element of claim 21 wherein the each notch further comprises a bottom surface extending between a first end and a second end, wherein each bottom surface defines a depth of its respective notch measured perpendicularly from the upper planar surface, and wherein the depth of the first notch at its first end is substantially the same as the depth of the second notch at its first end, and wherein the depth of the first notch at its second end is substantially the same as the depth of the second notch at its second end, the depth of each second end being greater than the depth of each first end.

23. The cuffing element of claim 22 wherein the first end of each bottom surface is disposed at the upper planar surface and the second end of each bottom surface is disposed at the outer surface of the base portion.

24. The cutting element of claim 18 wherein each notch forms a leading cutting edge with the beveled surface and forms a trailing cutting edge with the upper planar surface, the trailing cutting edge being closer to the first reference plane than the leading cutting edge.

25. The cutting element of claim 24 wherein the leading cuffing edge of the first notch and the leading cutting edge of the second notch intersect at a second upper surface that has a second extension height that is less than the first extension height.

26. A cutting element for a drill bit comprising:

a base portion having a base axis and an outer surface;

a cutting portion extending from the base portion and having a cutting surface, wherein the cutting surface includes a planar upper surface defining an extension height and a radiused transition surface disposed between the upper planar surface and the outer surface of the base portion;

an indentation formed in the cutting surface and extending at least partially through the upper planar surface and the transition surface; and wherein the indentation includes a forward facing formation engaging surface and a lower surface defining a depth of the indentation measured perpendicularly from the upper planar surface.

27. The cutting element of claim 26, wherein the forward facing formation engaging surface intersects the upper planar surface to form a trailing cutting edge and the lower surface intersects the transition surface to form a leading cutting edge, the trailing cutting edge being positioned closer to the base axis than the leading cutting edge.

28. The cutting element of claim 27, wherein the transition surface has a non-uniform radius of curvature between 0.015 in. and 0.030 in.

29. The cutting element of claim 27, wherein the indentation comprises a depression, and wherein the depth of the second end of the lower surface is greater than the depth of the first end of the lower surface.

30. The cutting element of claim 26 further comprising a frustoconical beveled surface extending between the transition surface and the outer surface of the base portion.

31. The cutting element of claim 30, wherein the indentation comprises an elongate notch, and wherein the forward facing formation engaging surface is at least partially perpendicular to the upper planar surface and at least partially parallel to the base axis.

32. The cutting element of claim 31 wherein the leading cutting edge and the trailing cutting edge each have a radius of curvature between 0.015 in. and 0.030 in.

33. The cutting element of claim 31 wherein the first end of the bottom surface is disposed at the upper planar surface and the second end of the bottom surface is disposed at the outer surface of the base portion.

34. The cutting element of claim 31 wherein the first notch extends along a median line that is substantially linear in top view.

35. A drill bit for cutting a borehole through an earthen formation having a sidewall, corner and bottom, the bit comprising:

a bit body having a bit axis;

a rolling cone cutter mounted on the bit body and adapted for rotation about a cone axis;

an insert having a base portion secured in the rolling cone cutter and having a cutting portion extending therefrom, the insert having an initial impact direction;

wherein the cutting portion has a cutting surface comprising:

a planar surface defining an extension height;

an indentation extending at least partially through the upper planar surface, the indentation including a forward facing formation engaging surface, a trailing cutting edge, a leading cutting edge, and a lower surface defining a depth of the indentation.

36. The cutting element of claim 35, wherein the base portion includes an outer cylindrical surface, and wherein a transition surface extends between the upper planar surface and the outer surface of the base portion.

37. The cutting element of claim 36, wherein the forward facing formation engaging surface intersects the upper planar surface to form the trailing culling edge and the lower surface intersects the transition surface to form the leading culling edge.

38. The cutting element of claim 37, wherein the indentation comprises a depression, and wherein the depth of the second end of the lower surface is greater than the depth of the first end of the lower surface.

39. The cutting element of claim 35 further comprising a frustoconical beveled surface extending between the upper planar surface and the outer surface of the base portion, wherein the beveled surface defines a bevel angle measured between the beveled surface and an extension of the outer surface of the base portion, wherein the bevel angle is between 10° and 75°.

40. The culling element of claim 39, wherein the indentation comprises an elongate notch, and wherein the forward facing formation engaging surface is at least partially perpendicular to the initial impact direction.

41. The cutting element of claim 40, wherein the base portion includes an outer cylindrical surface, and wherein the first end of the bottom surface is disposed at the upper planar surface and the second end of the bottom surface is disposed at the outer surface of the base portion.

42. The cutting element of claim 41 wherein the first notch extends along a median line that is substantially liner in top view.

43. The drill bit of claim 40 wherein the depth of the first notch at the second end is substantially the same as the extension height.

44. The drill bit of claim 40 comprising a plurality of inserts arranged in a circumferential row about the rolling cone cutter, wherein each of the plurality of inserts has a base portion secured in the rolling cone cutter and a cutting portion extending therefrom;

wherein the cutting portion of each of the plurality of inserts has a cutting surface comprising:

a planar surface defining an extension height;

a beveled surface disposed between the upper planar surface and an outer surface of the base portion; and a first notch extending through the upper planar surface and at least partially through the beveled surface, wherein the first notch includes a forward facing formation engaging surface.

45. The drill bit of claim 44 wherein each of the plurality of inserts is oriented on the rolling cone cutter such that the beveled surface and the forward facing formation engaging surface of each insert are positioned to at least partially engage the borehole sidewall upon impact of the insert with the formation.

46. The drill bit of claim 45 wherein the rolling cone cutter has a heel surface, and the cutting portion of each of the plurality of inserts in the circumferential row extends from the heel surface of the rolling cone cutter.

* * * * *